United States Patent [19]

Yashina

[11] Patent Number: 5,068,643

[45] Date of Patent: Nov. 26, 1991

[54] BURGLARPROOF DEVICE

[75] Inventor: Kazuo Yashina, Tokyo, Japan

[73] Assignee: Teio Tsushin Kogyo Kabushiki Kaisha, Tokyo, Japan

[21] Appl. No.: 489,084

[22] Filed: Mar. 5, 1990

[30] Foreign Application Priority Data

| | | | |
|---|---|---|---|
| Mar. 27, 1989 | [JP] | Japan | 1-074397 |
| Nov. 10, 1989 | [JP] | Japan | 1-293197 |
| Nov. 10, 1989 | [JP] | Japan | 1-293198 |
| Jan. 31, 1990 | [JP] | Japan | 2-20620 |
| Jan. 31, 1990 | [JP] | Japan | 2-20621 |

[51] Int. Cl.[5] ..... G08B 13/24

[52] U.S. Cl. ..... 340/571; 250/215; 340/522; 340/568

[58] Field of Search ..... 340/571, 568, 522; 250/215

[56] References Cited

U.S. PATENT DOCUMENTS

| | | | |
|---|---|---|---|
| 3,836,901 | 9/1974 | Matto et al. | 340/522 |
| 3,930,249 | 12/1975 | Steck et al. | 340/571 |
| 4,316,181 | 2/1982 | Primont et al. | 340/571 |
| 4,558,307 | 12/1985 | Lienart van Lidt de Jeude | 340/568 |
| 4,833,456 | 5/1989 | Heller | 340/571 |

*Primary Examiner*—Glen R. Swann, III

*Attorney, Agent, or Firm*—Wenderoth, Lind & Ponack

[57] ABSTRACT

A theft prevention device includes an optical sensor for detecting a level of ambient light and a vibration sensor for detecting a vibration of a protected article. The theft prevention device further includes an alarm circuit operatively coupled to the optical sensor and the vibration sensor for providing an alarm when the optical sensor detects a change in the level of ambient light from relative brightness to relative darkness and the vibration sensor detects a vibration of the protected article. The theft prevention device may further include a disconnection sensor for detecting a disconnection of a member attached to the protected article, whereby the alarm circuit activates the alarm upon such disconnection. The theft prevention device may further include a microswitch which is automatically activated upon removal of the protected article from an article casing. Still furthermore, the theft prevention device may include devices located at an exit of a place in which the protected article is located for emitting a high frequency light which may be detected by the optical sensor.

26 Claims, 39 Drawing Sheets

BURGLARPROOF DEVICE

BACKGROUND OF THE INVENTION

The present invention relates to a theft prevention device for preventing the theft of goods, and more particularly, to a small-sized theft prevention device capable of preventing the theft of such goods with certainty and reliability.

A theft prevention device is typically composed of a tag which is attached to the protected goods and an electromagnetic wave projector installed at a gate or an entrance and exit of a shop for exciting the tag. With the arrangement of the prior art theft prevention device, when the goods having an attaching tag are passed through the gate, an alarm is sounded to thereby prevent the theft of the goods. There are proposed several systems of the prior art theft prevention device.

In a first system, the theft prevention device includes a tag which is attached to the goods and which is composed only of a resonator serving as an antenna, and an electromagnetic projector installed at the exit gate for exciting the resonator by emitting a powerful electromagnetic wave to the resonator and sounding the alarm upon reception of a reflected wave from the tag. It is possible to prevent the goods from being unknowingly carried out since the resonator of the tag resonates upon reception of the electromagnetic wave emitted by the electromagnetic wave projector and emits a reflected wave, and the electromagnetic wave projector sounds the alarm upon the reception of the reflected wave.

In a second system, the device includes a tag which is attached to the goods and which is composed of a resonator serving as an antenna, a receiver, a sound generator, and an electromagnetic projector installed at an exit gate for emitting a powerful electromagnetic wave to the resonator for exciting the resonator of the tag. It is possible to prevent the goods from being unknowingly carried out since the resonator of the tag resonates upon reception of the electromagnetic wave emitted by the electromagnetic wave projector when the goods are passed through the gate, whereby the receiver is operated to actuate the sound generator for generating a sound from the tag.

In a third system, the theft prevention device includes a tag which is attached to the goods and which is composed of a resonator serving as an antenna, a receiver, a transmitter, a radar device and an electromagnetic projector installed at an exit gate for emitting a powerful electromagnetic wave to the resonator for exciting the resonator of the tag. It is possible to prevent the goods from being unknowingly carried out since the resonator of the tag resonates upon reception of the electromagnetic wave emitted by the electromagnetic wave projector when the goods are passed through the gate, whereby the receiver is operated to actuate the transmitter for generating the electromagnetic wave which is detected by the radar device.

However, there are drawbacks in the prior art theft prevention device in that a powerful electromagnetic wave is required to be emitted from the electromagnetic wave projector installed in the exit gate for exciting the resonator of the tag. In a country where a Wireless Telegraphy Act prohibits the emission of such a powerful electromagnetic wave, the electromagnetic wave projector cannot be used.

According to the first to third systems of the prior art theft prevention device, although the tag is provided with an antenna also serving as a resonator for receiving the electromagnetic wave, the size of the antenna cannot be reduced.

To solve the drawbacks set forth above, the present inventor proposed a small sized theft prevention device which does not use an electromagnetic wave. The principle of this device resides in detecting light and vibration and sounding an alarm when the detected light and vibration meet a prescribed condition. However, there is no vibration sensor available which is suitably adapted for meeting the prescribed condition.

SUMMARY OF THE INVENTION

The present invention has been made to solve the drawbacks set forth above.

It is therefore an object of the present invention to provide a small-sized theft prevention device capable of omitting the electromagnetic wave projector of the prior art and capable of preventing a theft with certainty.

It is another object of the present invention to provide a theft prevention device provided with a vibration sensor having a simple structure and obtainable at a low price.

It is still another object of the present invention to provide a theft prevention device capable of sounding an alarm when a good is passed under light having a predetermined frequency.

It is a further object of the present invention to provide a theft prevention device capable of reliably operating with the use of an optoelectronic signal generated by an optoelectronic element.

To achieve the above objects, a theft prevention device according to a first aspect of the present invention includes an optical sensor for detecting the brightness and darkness of a light level, a vibration sensor for detecting the vibration of a good, and an alarm circuit for receiving a signal provided by the optical sensor and a signal provided by the vibration sensor for sounding an alarm when the signal provided by the optical sensor indicates a change in the light level from brightness to darkness and the vibration sensor indicates a vibration of the good and a predetermined time is lapsed.

A theft prevention device according to a second aspect of the present invention includes an optical sensor for detecting the brightness and darkness of a light level, a vibration sensor for detecting the vibration of a good, a disconnection sensor for detecting the cutting of a member attached to the good, an alarm circuit for receiving a signal provided by the optical sensor, a signal provided by the vibration sensor and a signal provided by the disconnection sensor and for sounding an alarm when the signal provided by the optical sensor indicates a change in the light level from brightness to darkness and the vibration sensor indicates a vibration of the good, or when the signal provided by the disconnection sensor indicates a cutting of the member, and a predetermined time is lapsed.

A theft prevention device according to a third aspect of the present invention includes an alarm circuit capable of sounding an audible alarm.

A theft prevention device according to a fourth aspect of the present invention includes an alarm circuit capable of activating an alarming by an electromagnetic wave.

A theft prevention device according to a fifth aspect of the present invention includes an optical sensor for detecting the brightness and darkness of a light level, a vibration sensor for detecting the vibration of a good, and an alarm circuit for receiving a signal provided by the optical sensor and a signal provided by the vibration sensor and for sounding an alarm when the signal provided by the optical sensor indicates a change in the light level from brightness to darkness and the vibration sensor indicates a vibration of the good and a predetermined time is lapsed, the vibration sensor being composed of a body which is movable in response to the vibration and a detecting body for detecting the operation of the movable body.

A theft prevention device according to a sixth aspect of the present invention is characterized in that the vibration sensor is provided with a movable body which is composed of a shaft implanted on a base, a stick-like plate rotatably and pivotally mounted on the shaft at one end thereof, a conductive member mounted at the other end of the stick-like plate and a coil spring for urging the stick-like plate to a predetermined position, and a detecting body having a conductive stopper provided with projecting pieces which is positioned along the radius of the stick-like plate along which the conductive member moves.

A theft prevention device according to a seventh aspect of the present invention includes an optical sensor for detecting a light level and converting the detected light level to an electric signal, a vibration sensor for detecting the vibration of a good and for converting the detected vibration to an electric signal, and an alarm circuit for receiving the electric signals provided by the optical sensor and the vibration sensor and for sounding an alarm when the electric signal provided by the optical sensor exceeds a predetermined frequency at the time when a vibration is detected by the vibration sensor.

A theft prevention device according to an eighth aspect of the present invention includes a light emitting device provided at an entrance and exit of a place where the theft prevention device is installed so as to light at the frequency other than a commercial frequency exceeding a predetermined frequency.

A theft prevention device according to a ninth aspect of the present invention includes an optoelectronic element for generating an optoelectronic voltage in response to the incidence of light, an optical processing circuit for receiving the optoelectronic voltage generated by the optoelectronic element for charging a cell which supplies power to components of the theft prevention device, a vibration sensor for detecting the vibration of a good and providing a corresponding signal, and an alarm circuit for receiving the signal provided by the vibration sensor and the signal provided by the optoelectronic element for sounding an alarm when the electric signal provided by the optoelectronic element indicates a change in the light level from brightness to darkness and the vibration sensor indicates a vibration of the good and a predetermined time is lapsed.

A theft prevention device according to a tenth aspect of the present invention includes an optoelectronic element for generating an optoelectronic voltage in response to the incidence of light, an optical processing circuit for receiving the optoelectronic voltage generated by the optoelectronic element and for providing a corresponding signal, a vibration sensor for detecting the vibration of a good and for providing a signal indicative of the vibration, and an alarm circuit for receiving the signal provided by the vibration sensor and the signal provided by the optical processing circuit and for sounding an alarm when the signal provided by the optical processing circuit indicates a change in the light level from brightness to darkness at a time when the vibration sensor indicates a vibration.

A theft prevention device according to an eleventh aspect of the present invention includes an optical sensor for detecting the brightness and darkness of a light level, a vibration sensor composed of a mold body and a Hall-effect element and a ball member respectively housed therein for detecting the vibration of a good, and an alarm circuit for receiving a signal provided by the optical sensor and a signal provided by the vibration sensor and for sounding an alarm when the signal provided by the optical sensor indicates a change in the light level from brightness to darkness and the vibration sensor indicates a vibration of the good and a predetermined time is lapsed, the invention being characterized in that the ball member is magnetic and movably disposed on a detecting surface of the Hall-effect element.

A theft prevention device according to a twelfth aspect of the present invention includes the vibration sensor provided with a mold body having therein a cylindrical hollow portion in which a ball member made of magnetic material is disposed and a Hall-effect element having a detecting surface which is confronted with the inner periphery of the cylindrical hollow portion.

The above and other objects, features and advantages of the present invention will become more apparent from the following description taken in conjunction with the accompanying drawings.

DESCRIPTION OF THE PREFERRED EMBODIMENT

First Embodiment (FIGS. 1 to 4)

Figure 1:
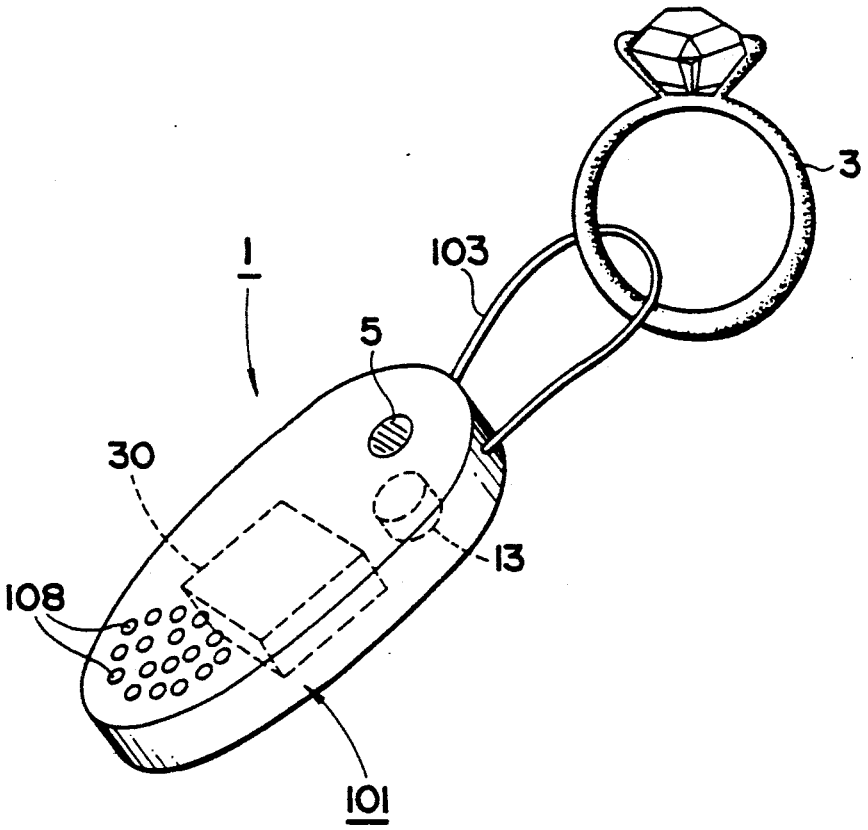
FIG. 1 is a perspective view showing a theft prevention device according to a first embodiment of the present invention.

A theft prevention device according to a first embodiment of the present invention will be described with reference to FIGS. 1 to 4.

A theft prevention device 1 is attached to a good 3 via an attaching cord 103 serving also as a disconnection sensor. The device 1 includes a body 101 having a pendant shape. The body 101 has incorporated therein an optical sensor 5, a vibration sensor 13, an alarm circuit 30, and a plurality of openings 108 for emitting sound.

Figure 2:
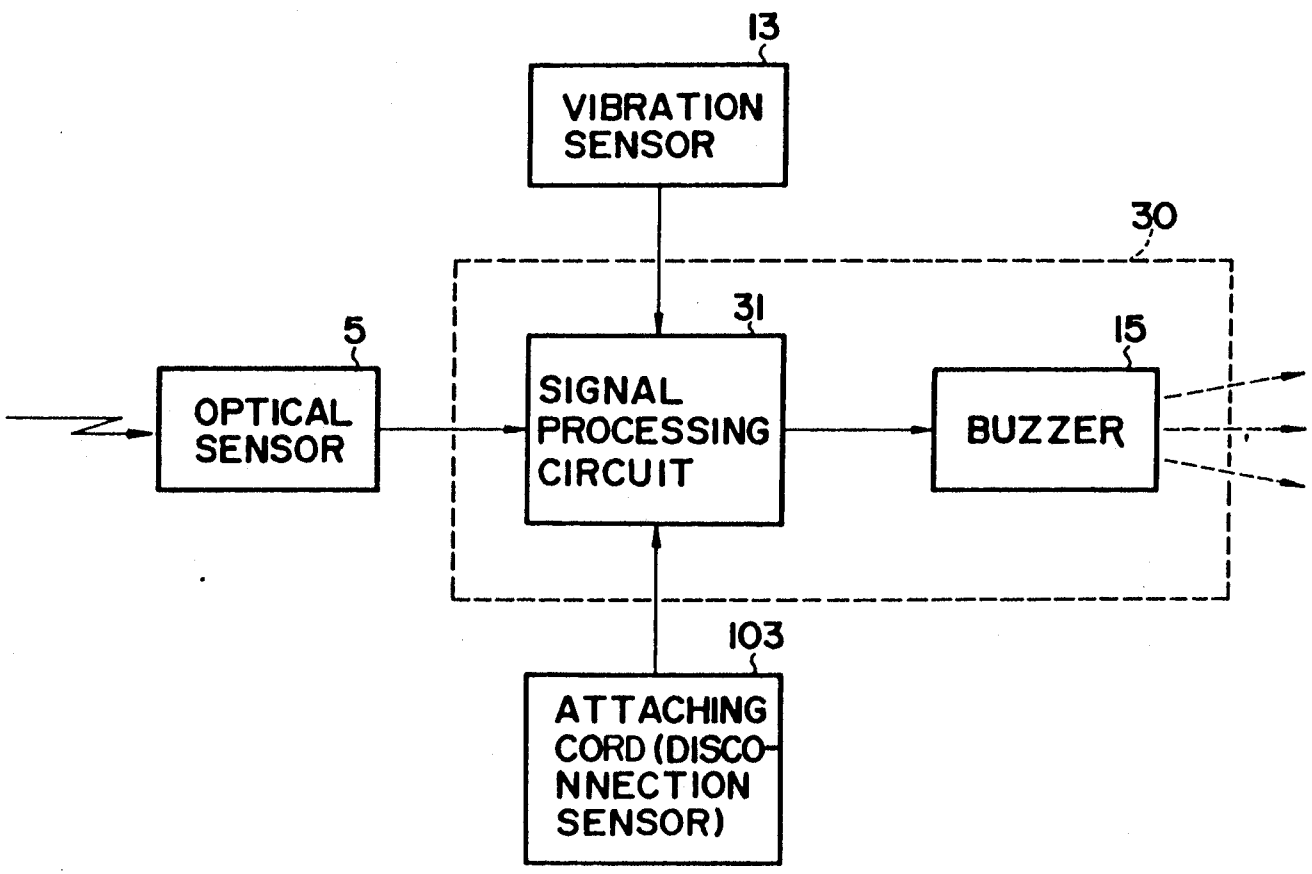
FIG. 2 is a block diagram showing an arrangement of FIG. 1.

The block diagram in FIG. 2 illustrates the optical sensor 5, the vibration sensor 13 and the alarm circuit 30 of the device 1. The optical sensor 5 detects the brightness and darkness of a light level and thereafter makes an optoelectronic conversion, such as a photodiode, a phototransistor, or a solar cell. The vibration sensor detects vibration and thereafter converts the detected vibration to an electric signal, such as a mercury switch, a magnetic switch or a magnetic flux switch. The disconnection sensor 103 (attaching cord) detects the electrical disconnection of the attaching cord 103 from the good 3. The alarm circuit 30 includes a signal processing circuit 31 and a buzzer 15. The signal processing circuit 31 receives the electric signal from the optical sensor 5 and the electric signal from the vibration sensor 13 and sounds an alarm by activating the buzzer 15 when the detected signal from the optical sensor 5 denotes a light level variance from brightness to darkness after the lapse of a predetermined time and the detected signal from the vibration sensor 13 continues to denote a detected vibration, or when a signal from the disconnection sensor 103 continues to denote the disconnection of the attaching cord from the good 3.

Figure 3:
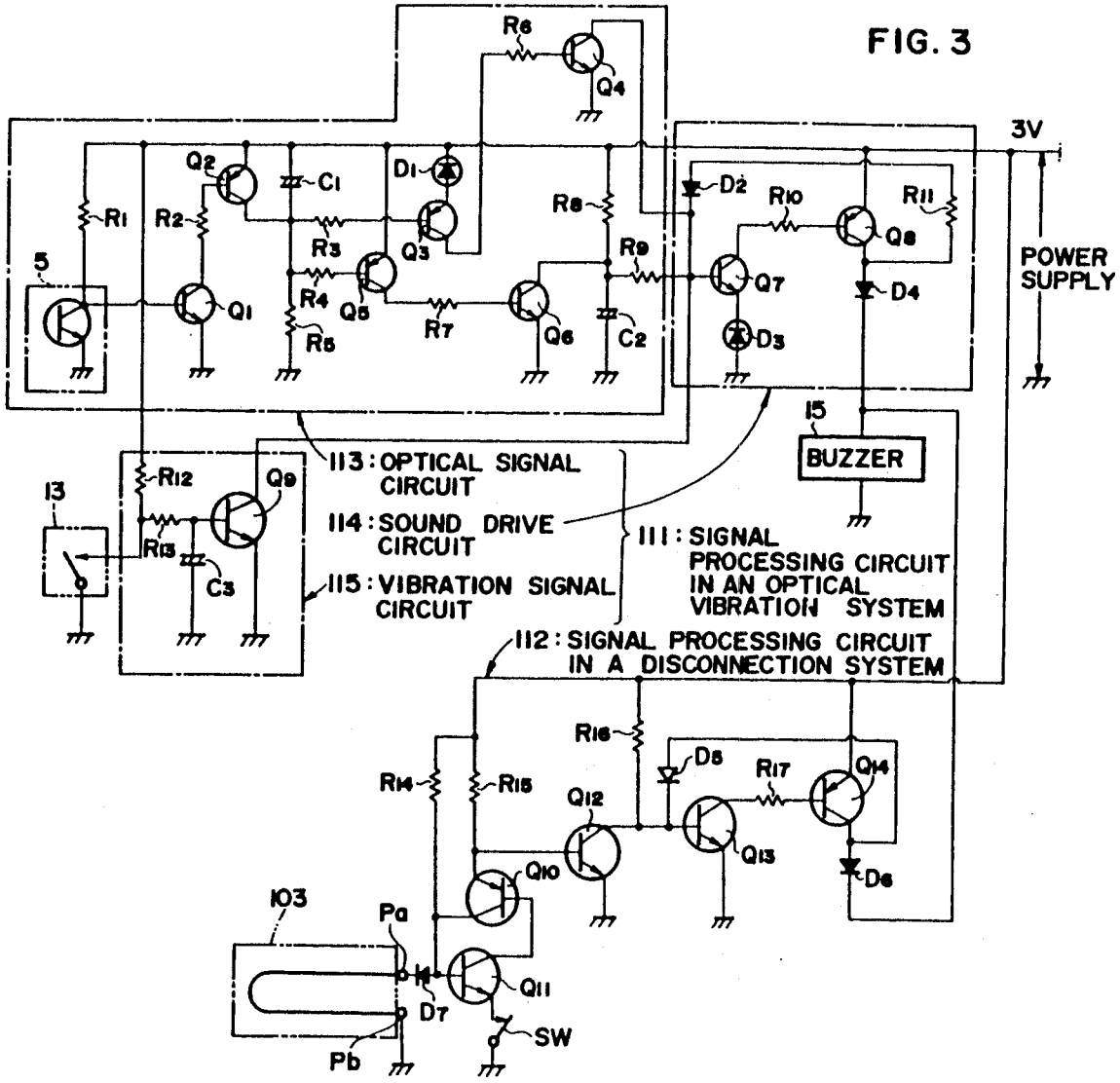
FIG. 3 is a circuit diagram showing the arrangement of FIG. 1.

The circuit diagram illustrated in FIG. 3 shows an arrangement of the signal processing circuit 31 which includes a signal processing circuit in an optical vibration system 111 and a signal processing circuit in a disconnection system 112. The signal processing circuit in the optical vibration system 111 includes an optical signal circuit 113, a sound drive circuit 114 and a vibration signal circuit 115. The signal processing circuit in the disconnection system 112 has a same circuit arrangement as the sound drive circuit 114. The optical signal circuit 113 includes resistors R1 to R9, transistors Q1 to Q6, capacitors C1, C2 and a diode D1. The resistor R1, the transistor Q2, the capacitor C1, the transistor Q5, the diode D1 and the resistor R8 are respectively connected to a power supply. The resistor R1 is connected to a collector of a transistor in the optical sensor 5. An emitter of the transistor in the optical sensor 5 is grounded. The transistor Q2 is connected to the resistor R2 at the base thereof. The transistor Q1 is connected to the collector of the transistor in the optical sensor 5 at the base thereof and grounded at the emitter thereof. The capacitor C1 is connected to the resistors R3, R4, and R5. The resistor R5 is grounded. The transistor Q5 is connected to the resistor R4 at the base thereof. The diode D1 is connected to an emitter of the transistor Q3. The transistor Q3 is connected to the resistor R3 at the base thereof and to the resistor R6. The transistor Q4 is connected to the resistor R6 at the base thereof and to a diode D2 in the sound drive circuit 114 at the collector thereof and grounded at the emitter thereof. The resistor R7 is connected to a collector of the transistor Q5 and to a base of the transistor Q6. The transistor Q6 is connected to the resistor R8 at the collector thereof and grounded at the emitter thereof. The capacitor C2 is connected between the resistors R8, R9 and ground. The resistor R9 is connected to the resistor R8.

The transistors Q2, Q3, Q5, the capacitor C1, and the resistor R5 operates to detect or cancel a short on-pulse signal.

The sound drive circuit 114 includes diodes D2 to D4, resistors R10, R11 and transistors Q7, Q8. The transistor Q8 is connected to a power supply at the emitter thereof, to the resistor R10 at the base thereof, to the resistor R11 at the collector thereof. The transistor Q7 is connected to the resistor R10 at the collector thereof, to the resistor R9 in the optical signal circuit 113 at the base thereof, and to the diode D3 of the emitter thereof. The resistor R11 is connected to the diode D2. The diode D3 is grounded and the diode D4 is connected to the resistor R11. The diode D4 is also connected to the buzzer 15. The resistors R10, R11, the transistors Q7, Q8, and the diodes D3, D4 constitute a Schmitt trigger circuit for turning off the sound drive circuit. The time lapsed from brightness to darkness is counted by the operation of the transistor Q6, the resistor R8, the capacitor C2, the transistor Q7 and the diode D3. A long on-pulse is detected or the alarm is released by the operation of the capacitor C1, the resistor R5, the diode D1 and the transistors Q3, Q4.

The signal processing circuit in the disconnection system 112 includes resistors R14 to R17, transistors Q10 to Q14 and diodes D5 to D7. The resistors R14 to R16 and the transistor R14 are connected to the power supply. The resistor 14 is connected to a collector of the transistor Q10 and to a base of the transistor Q11. The resistor R15 is connected to the resistor R14, to an emitter of the transistor Q10, and to a base of the transistor Q12. The resistor R16 is connected to a collector of the transistor Q12, to the diode D5 and a base of the transistor Q13. The diode D7 is connected to the base of the transistor Q11 and to a terminal Pa of the attaching cord 103. Another terminal Pb of the attaching cord 103 is grounded. A base of the transistor Q10 is connected to a collector of the transistor Q11 as a thyristor coupling. The transistor Q11 is connected in series to a reset switch SW at an emitter thereof. Transistor Q12 is grounded at the emitter thereof. The transistor Q13 is connected to the resistor R17 at a collector thereof and grounded at an emitter thereof. The transistor Q14 is connected to the resistor R17 at a base thereof and to the diode D6 at a collector thereof. The diode D6 is connected to the buzzer 15. The transistors Q13, Q14 and the diode D5 constitute a Schmitt trigger circuit.

The theft prevention device having the arrangement set forth above according to the first embodiment will be described hereinafter.

When the theft prevention device 1 is in motionless state, the vibration sensor 13 is turned off and the transistor Q9 is turned on so that the signal issued by the optical sensor circuit 113 is cancelled or grounded. Hence, the transistors Q7, Q8 in the sound drive circuit 114 are turned off so that no sound is generated.

Figure 4:
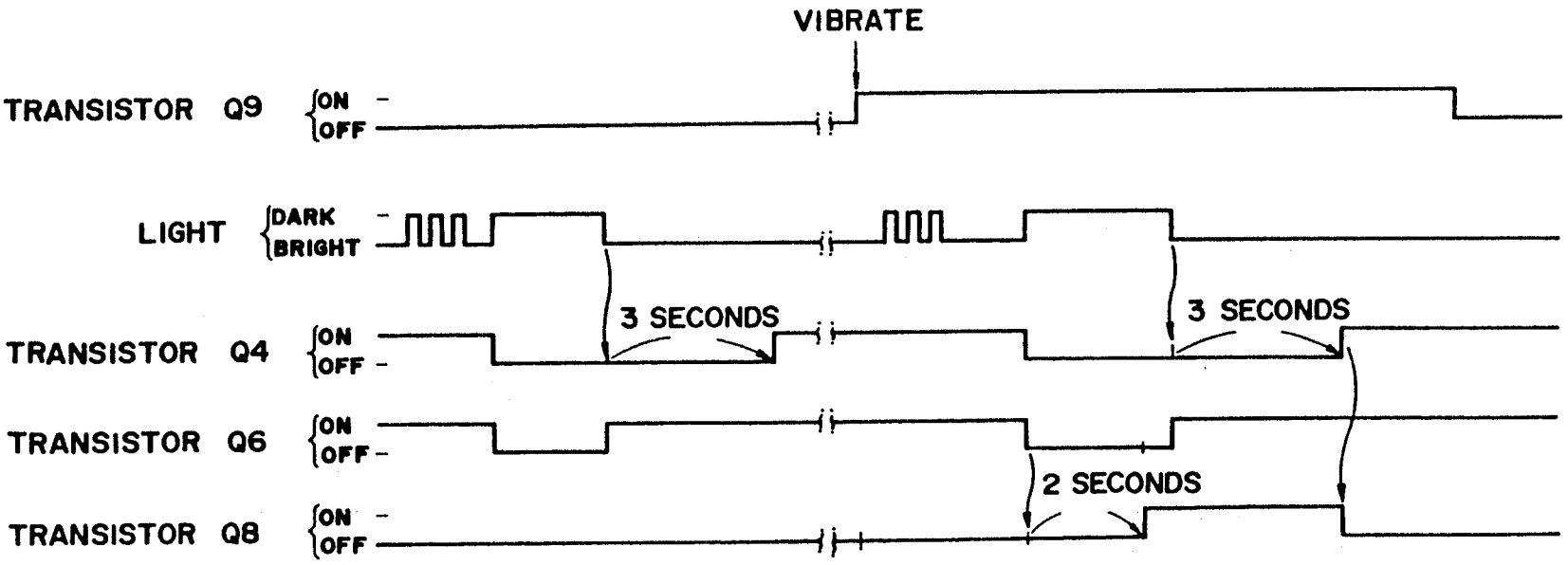
FIG. 4 is a timing chart showing an operation of the arrangement of FIG. 1.

When the good 3 is stolen, for example, when the good 3 is placed in a pocket, the vibration sensor 13 is turned on as illustrated in FIG. 4 and the transistor Q9 of the vibration signal circuit 115 is turned off. Accordingly, the signal issued by the optical signal circuit 113 is supplied to the sound drive circuit 114. Assuming that, at this time, the optical sensor 5 detects the state of darkness for more than a given time, then the transistors Q1, Q2 are turned on and the transistors Q3 to Q6 are turned off whereby the transistors Q7 and Q8 are turned off when the transistors Q3 to Q6 maintain an off state for more than a given time period on the basis of the operation of the resistor R8, the capacitor C2, the transistor Q7 and the diode D3, the buzzer 15 is activated. As a result, it is possible to detect that the good 3 is being stolen.

Whereupon, when the attaching cord 103 serving also as the disconnection sensor is severed from the good 3, a current flows from the resistor R14 to the base of the transistor Q11 for thereby turning on the transistors Q10, Q11. As a result, the transistor Q12 is turned off and the transistors Q13, Q14 are turned on whereby current is supplied through the transistor Q14 and the diode D6 to thereby activate the buzzer. The theft prevention device 1 having the above arrangement is operated to indicate the theft by sound.

Figure 5:
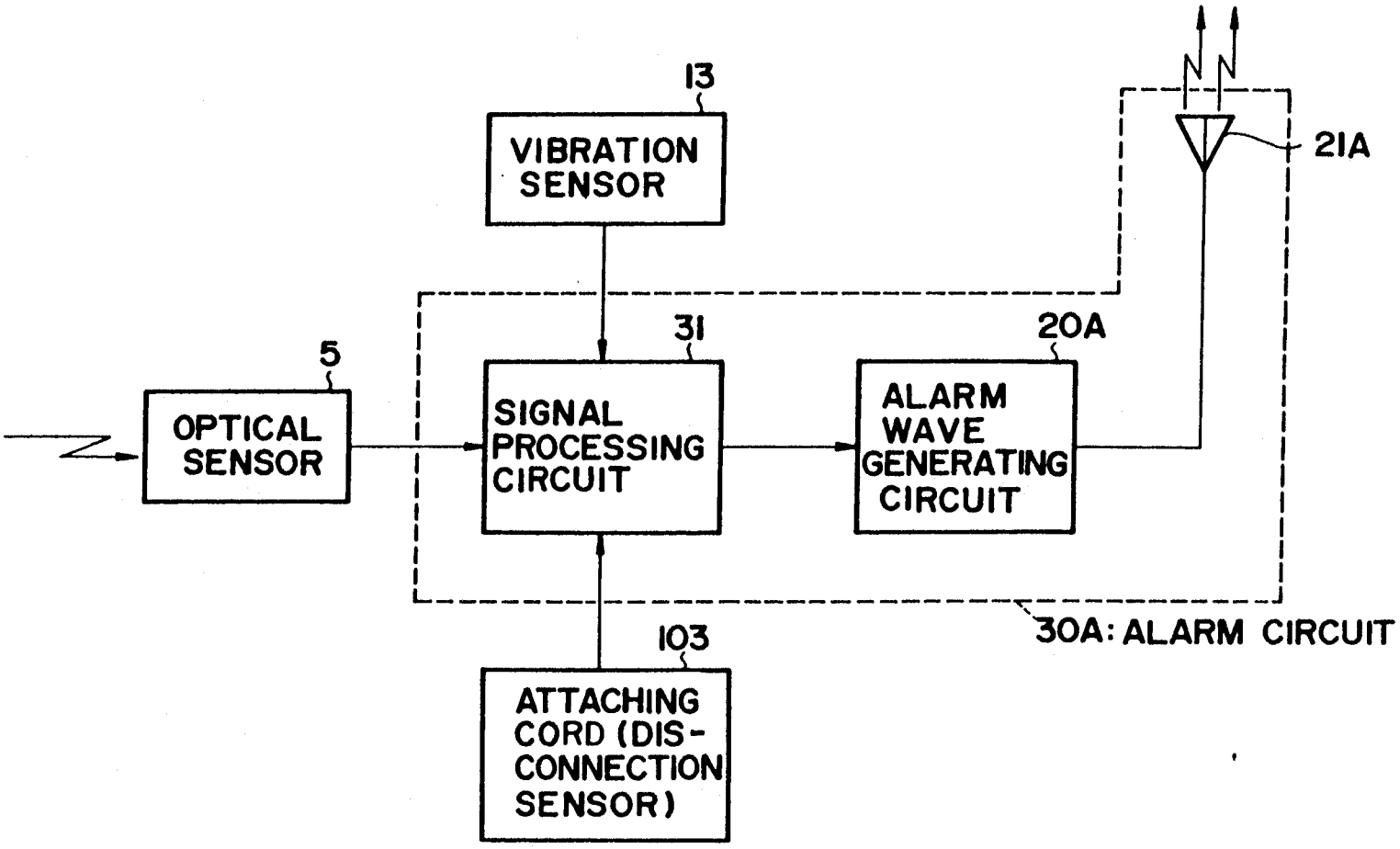
FIG. 5 is a block diagram showing an arrangement of a theft prevention device according to a second embodiment of the present invention.

Second Embodiment (FIG. 5)

A theft prevention device according to the second embodiment will be described with reference to FIG. 5.

The arrangement of the second embodiment is the same as that of FIG. 1 except that there is provided an alarm circuit 30A which includes an alarm wave generating circuit 20A for providing an electromagnetic wave which is substituted for the buzzer 15 and an antenna 21A for providing an electromagnetic wave from the alarm wave generating circuit 20A as well as the signal processing circuit 31.

When the good is stolen, the theft prevention device according to the second embodiment is operated in the same manner as that of the first embodiment to drive the alarm wave generating circuit 20A. As a result, the alarm wave generating circuit 20A is actuated to provide an electromagnetic wave from the antenna 21A. The electromagnetic wave thus provided from the antenna 21A is detected by a radar ETC to prevent the theft.

The arrangement of the theft prevention device according to the first and the second embodiment sounds the theft alarm when it detects a vibration after a lapse of a predetermined time when the light level is changed from brightness to darkness, or when it detects the disconnection of the good therefrom. As a result, the theft can be detected with assurance while eliminating devices which emit a powerful electromagnetic wave. Furthermore, a resonator which detects the electromagnetic wave is eliminated, thereby reducing the size of the device.

Still furthermore, an audible alarm is utilized so that the theft of the good can be immediately detected.

Still furthermore, the alarm can be activated using an electromagnetic wave so that the theft can be known only by the concerned party so that necessary steps can be taken.

Third Embodiment (FIGS. 6 to 12)

A theft prevention device according to a third embodiment of the present invention will be described with reference to FIGS. 6 to 12.

Elements constituting the device which are the same as those in the first and the second embodiments have the same numerals.

Figure 7:
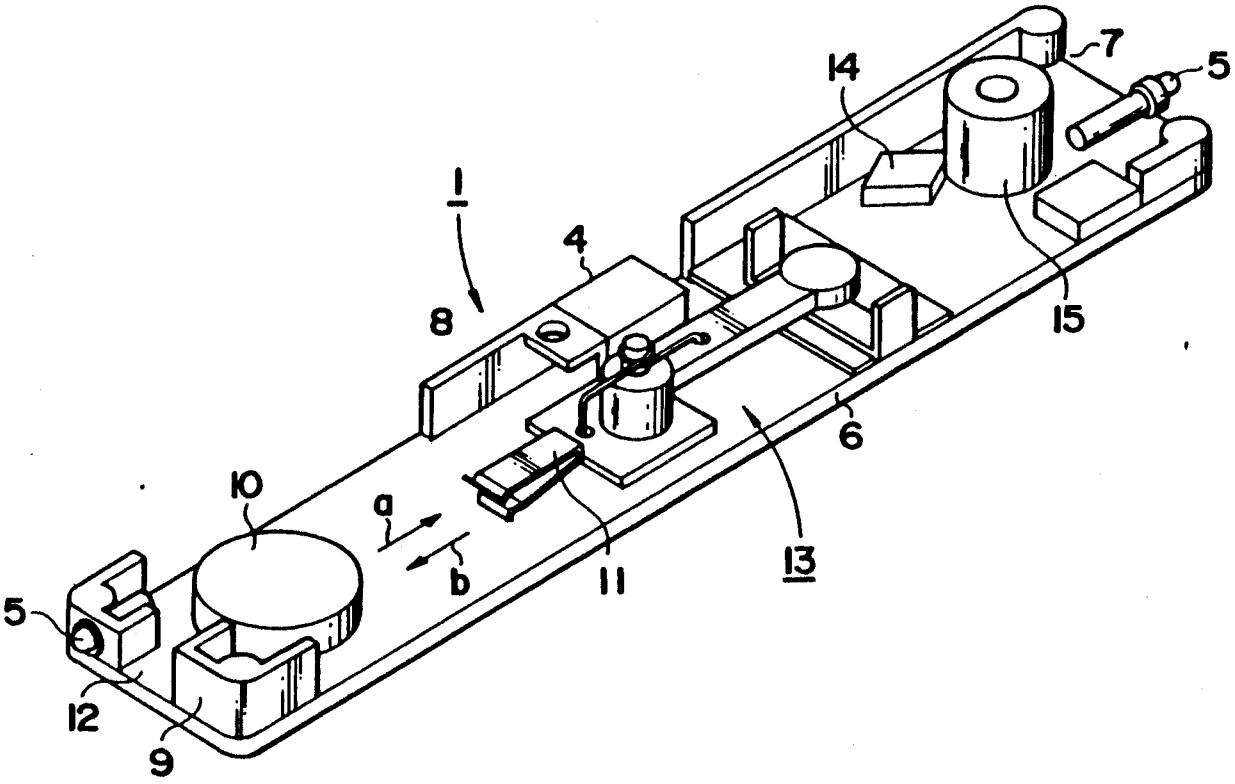
FIG. 7 is a diagram showing an arrangement of FIG. 6.
Figure 8:
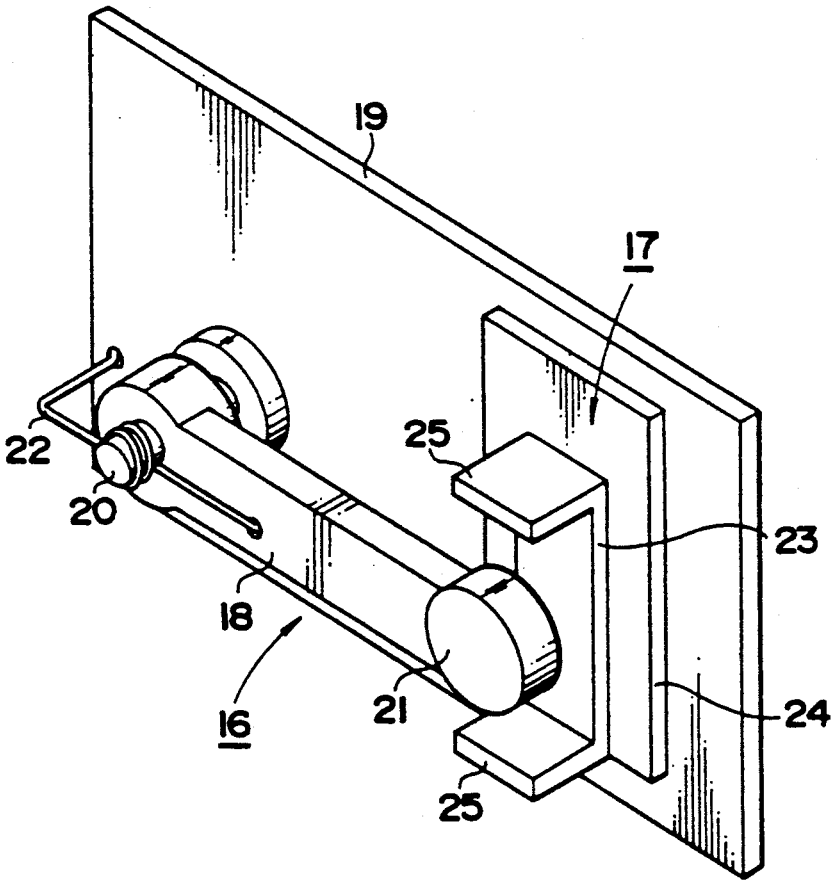
FIG. 8 is an enlarged perspective view showing a vibration sensor employed in the device of FIG. 7.

The theft prevention device 1 has a transparent case 2 fixed thereto at the upper portion thereof and the optical sensor 5 at the side thereof. The transparent case 2 can accommodate therein the good 3, such as a compact disk, etc. Disposed in the transparent case 2 and on the device 1 is an operation portion of a micro switch 4. When the operation portion of the micro switch 4 is pressed down by the good 3 the device 1 does not sound the alarm. However, when the good 3 is removed from the transparent case 2, namely stolen, the device 1 sounds the alarm. There are provided an operation portion of a cell and a second optical sensor 5 at the side opposite to the side portion where the first optical sensor 5 is provided. FIG. 7 is a perspective view showing an arrangement of principal elements constituting the device 1 in which the first optical sensor 5 is provided on short side-surface 7 which is fixed to the rectangular case 6 and the operation portion of the micro switch 4 is disposed on a long side-surface 8. There is provided at the side surface 9 opposite to the short side-surface 7 an operation hole 12 through which a mini cell 10 is moved toward (as illustrated by the arrow a) or moved away from (as illustrated by the arrow b) a mini cell holder 11. When the mini cell 10 is moved or inserted into the mini cell holder 11, the device 1 is actuatable. The second optical sensor 5 is provided at the portion adjacent to the operation hole 12. A vibration sensor 13 is provided at the portion adjacent to the mini cell holder 11. Provided at the upper portion of the vibration sensor 13 are an integrated circuit 14 for processing the operation of the vibration sensor 13 and a buzzer 15. A detailed arrangement of the vibration sensor 13 is illustrated in FIG. 8. The vibration sensor 13 includes a movable body 16 movable in response to the vibration and a detecting body 17 for detecting the movement of the movable body 16. The movable body 16 includes a shaft 20 fixed on a base and a stick-like plate 18 pivotally and rotatably mounted on the shaft 20, and a conductive member 21 at the other end of the stick-like plate 18 and a coil spring 22 for returning the stick-like piece 18 to a given position. The detecting body 17 includes a stopper 23 made of a conductive member formed in U-shape which is fixed to an insulating plate 24 on the base 19 and projecting pieces 25, 25 respectively protruded from both ends of the stopper 23. The conductive member 21 is slidably engaged in the U-shape stopper 23 and the projecting pieces 25, 25 are positioned along the movable radius of the conductive member 21 whereby the stopper 23 can detect the vibration electrically, that is, the vibration sensor 13 electrically detects the vibration when the conductive member 21 of the stick-like plate 18 contacts the projecting pieces 25, 25 of the stopper 23.

Figure 9:
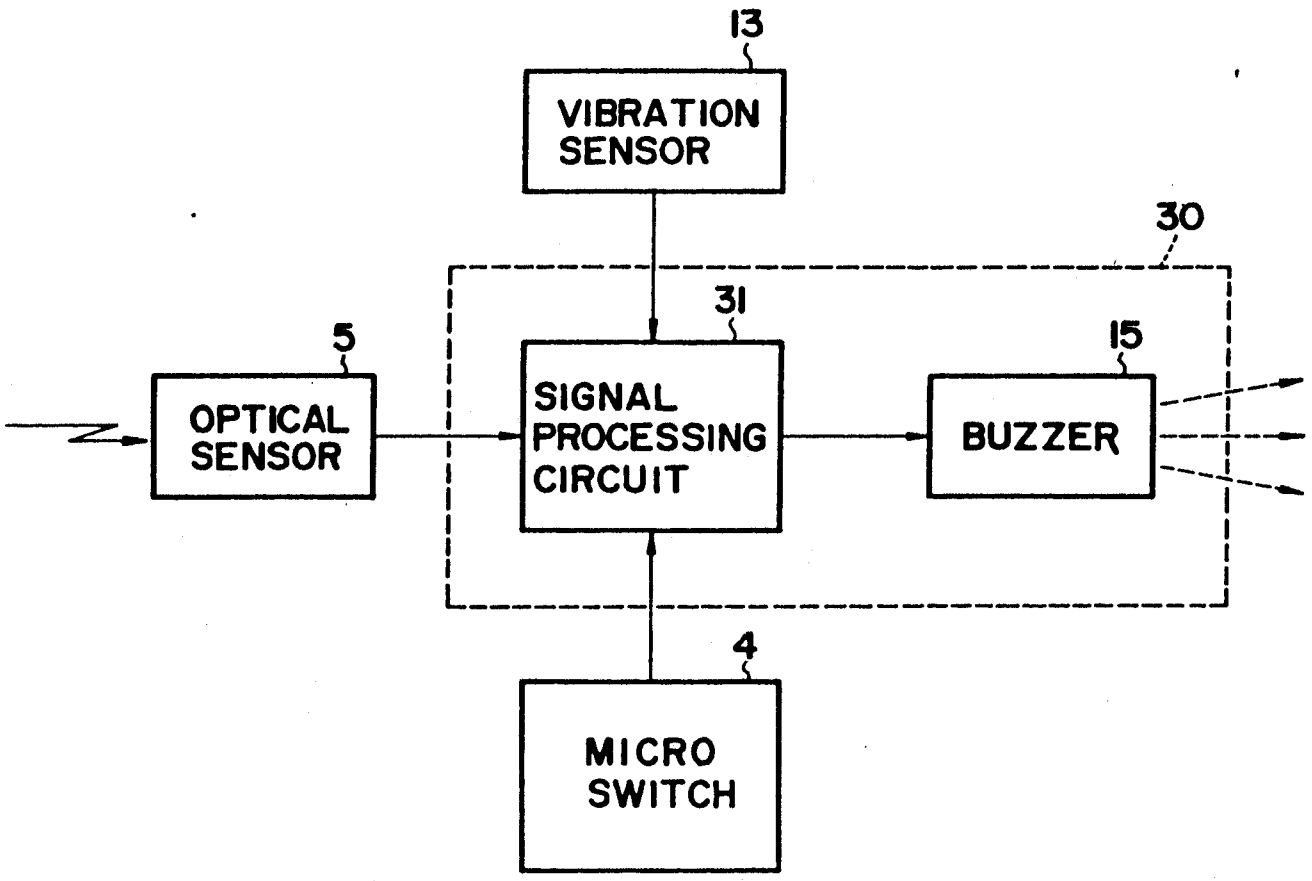
FIG. 9 is a block diagram showing the arrangement of FIG. 6.

FIG. 9 is a block diagram of the theft prevention device 1 according to the third embodiment. The arrangement is the same as that of the first embodiment except that the micro switch 4 is substituted for the disconnection sensor 103. The micro switch 4 is structured to electrically detect the removal of the good 3 from the transparent case 2. The signal processing circuit 31 receives a signal from the optical sensor 5, a signal from the vibration sensor 13, and a signal from the micro switch 4 and sounds the alarm by activating the buzzer 15 when the detected signal from the optical sensor 5 indicates that the light level is varied from brightness to darkness after the lapse of a predetermined time and the detected signal from the vibration sensor 13 continues detecting vibration, or when the micro switch 4 detects the removal of the good 3 from the transparent case 2.

Figure 10:
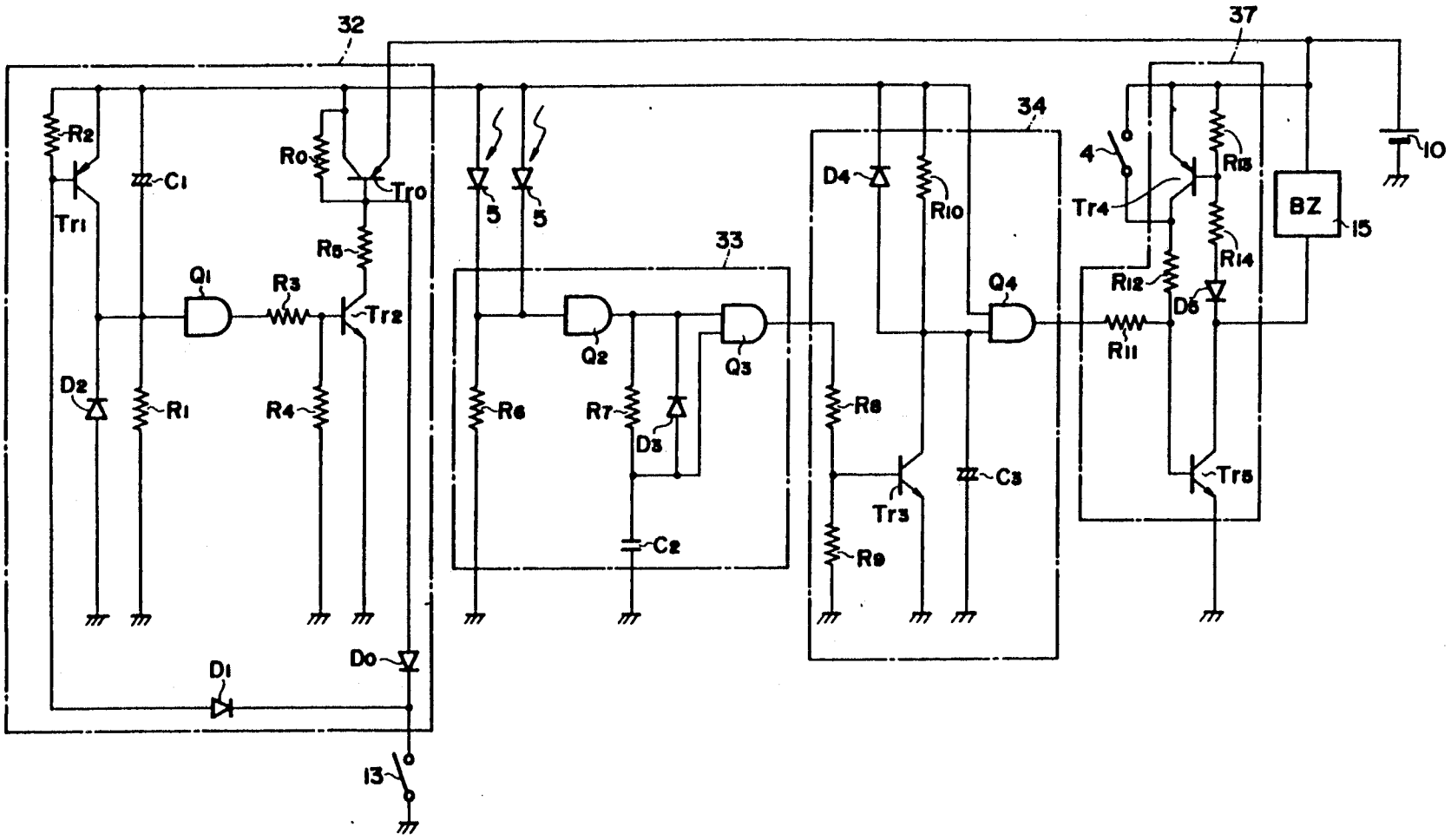
FIG. 10 is a circuit diagram showing the arrangement of FIG. 6.
Figure 11:
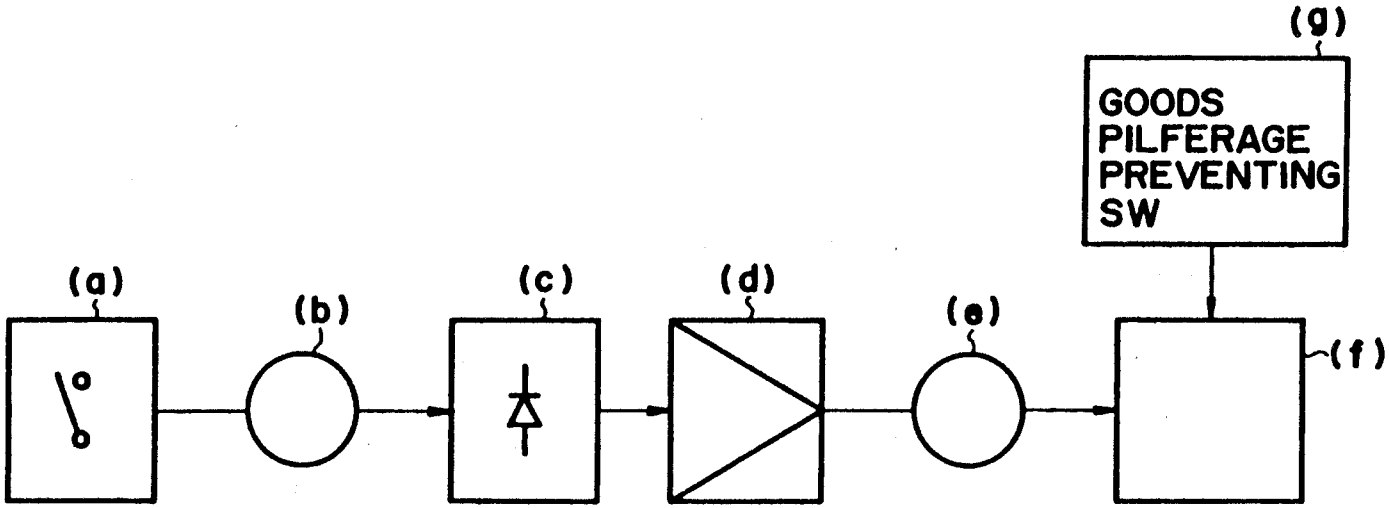
FIG. 11 is a view of assistance in explaining an operation of the arrangement of FIG. 6.

FIG. 10 shows a detailed circuit diagram of the signal processing circuit 31 which includes a vibration signal processing circuit 32 for processing the signal of the vibration sensor 13, a noise-removing circuit 33 for removing a specific frequency, for example, a frequency of at least 150 Hz from the signal of the optical sensor 5, a timer circuit 34 for providing an output signal when the signal from the noise-removing circuit 33 is provided for a predetermined time, and a drive circuit 35 for driving the buzzer 15 upon reception of the signal provided by the timer circuit 34 or the micro switch 4.

The vibration signal processing circuit 32 includes transistors Tr0, Tr1, Tr2, resistors R0, R1 to R3, diodes D0, D1, D2, a capacitor C1, an amplifier Q1, a power supply switching circuit and a holding circuit for turning on the power supply switching circuit for a given time.

The transistor Tr0 is connected to the mini cell 10 as the power supply at an emitter thereof, to the resistor R5 at a base thereof and to the resistor R0 at a collector thereof. The transistor Tr2 is connected to the resistor R5 at a collector thereof, to the resistor R3 at a base thereof and grounded at an emitter thereof. The resistor R4 is grounded at one terminal and is connected to a junction point between the resistor R3 and the transistor Tr2 at the other terminal.

The noise-removing circuit 33 includes the optical sensors 5, an amplifier circuit Q2 for receiving a detected optical signal from a junction point between the optical sensors 5 and a resistor R6' and a low-pass filter composed of a resistor R7, a capacitor C2, a diode D2, and an AND circuit Q3 for removing the noise from the detected signal provided by the amplifier circuit Q2. One end of the diodes 5 is connected to the resistor R6 which is grounded. The resistor R7 is connected to the output terminal of the amplifier circuit Q2 and to the capacitor C2 which is grounded. The diode D3 is connected at the junction point between the resistor R7 and the capacitor C2 and to the input terminal of the AND circuit Q3.

The timer circuit 34 includes an input amplifying portion composed of input resistors R8 to R9, a transistor Tr3 and a delay circuit composed of a resistor R10, a diode D4, a capacitor C3, and an AND circuit Q4, whereby an output is provided from the AND circuit Q4 when an input signal is "1" even if a predetermined time, for example, only 3.5 seconds has lapsed. The resistor R8 is connected to an output of the AND circuit 13 and to the resistor R9 in series. The resistor R9 is grounded. A junction point between the resistors R8, R9 is connected to the transistor Tr3 at a base thereof. The transistor Tr3 is grounded at the emitter thereof and connected to the resistor R10 at a collector thereof. The resistor R10 is connected to the diode D4 and one input terminal of the AND circuit Q4. The diode D4 is connected to the other input terminal of the AND circuit Q4.

The drive circuit 37 includes a buzzer switch circuit composed of an input resistor R11 connected to an output terminal of the AND gate Q4 and a driving transistor Tr5 having emitter which is grounded and a base connected to the resistor R11 and collector connected to a diode D4, and a holding circuit composed of resistors R12 to R14, a transistor Tr4 and the diode D4 for keeping the buzzer switch circuit turned on.

The operation of the third embodiment of the present invention will be described hereinafter.

When the device 1 is in a motionless state, the vibration sensor 13 is turned off and the transistor Tr0 is turned off. Hence, no power is supplied to the vibration signal processing circuit 32, the noise-removing circuit 33, and the timer circuit 34 from the mini cell 10, so that these circuits do not operate.

Figure 12:
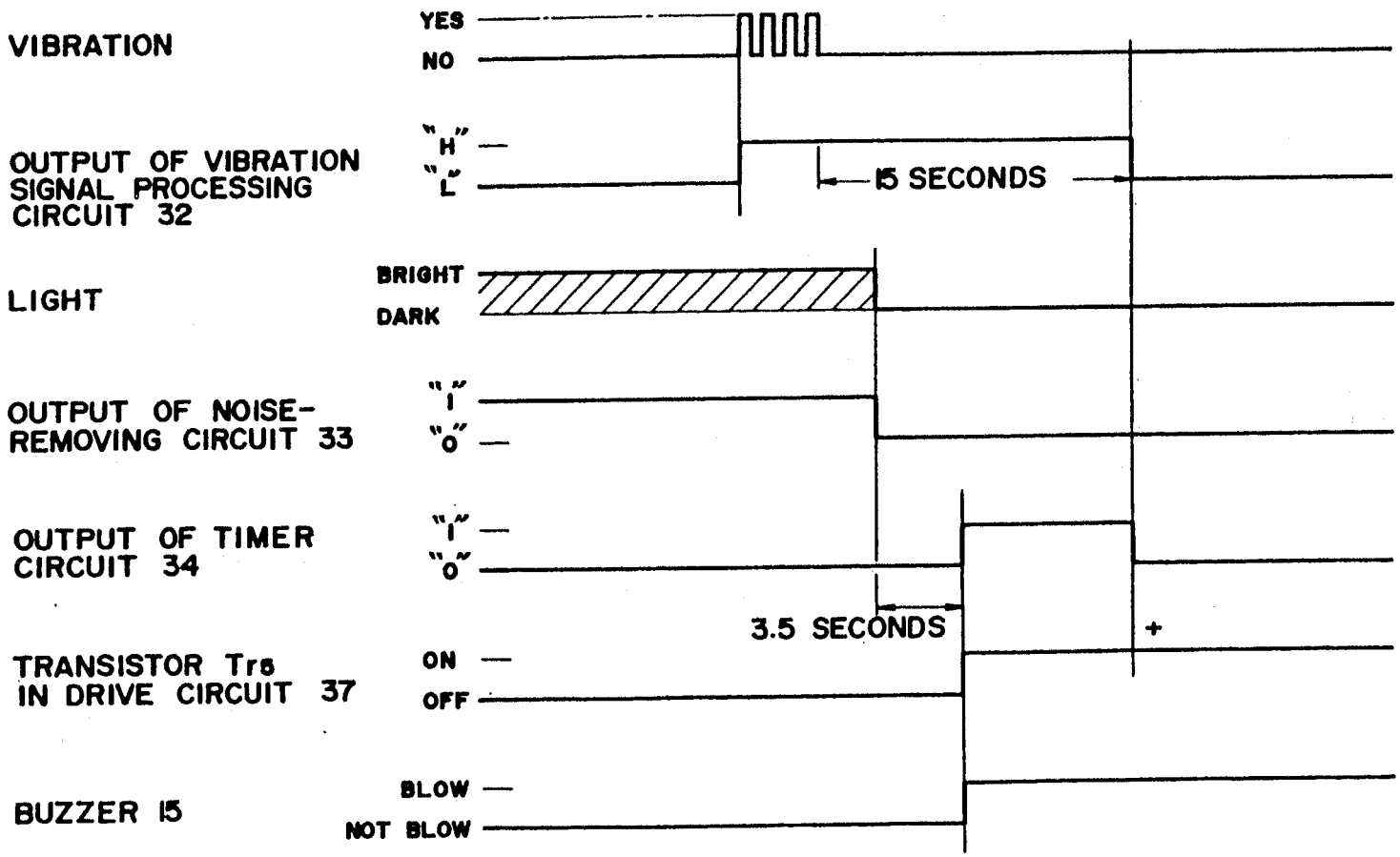
FIG. 12 is a timing chart showing an operation of the arrangement of FIG. 6.

When the good 3 is removed from the transparent case 2, the micro switch 4 is turned on and the transistor Tr5 is maintained in an on state by the holding circuit composed of the resistors R12 to R14, the transistor Tr4 and the diode D4. Accordingly, the buzzer 15 keeps sounding even if the good 3 is returned to the transparent case 2 (FIGS. 11 (*g*) and (*f*)). Referring to FIG. 12, suppose that the good is stolen in a state where the good is accommodated in the transparent case 2, for example, when the good is placed in a pocket which usually involves vibration. When the vibration is detected by the vibration sensor (FIG. 11(*a*)), the transistor Tr0 is turned on so that the power is supplied from the mini cell 10 to the vibration signal processing circuit 32, the noise-removing circuit 33, the timer circuit 34. At the same time, the transistor Tr1 is turned on and the vibration signal processing circuit 32 continues to provide a signal "1" for a predetermined time from the time when the vibration sensor 13 is turned off. As a result, the transistor Tr2 is turned on and the transistor Tr0 is turned on whereby the power is supplied to the vibration signal processing circuit 32, and the timer circuit 34 (FIG. 11(*b*)). At this state, when the light level is detected by the optical sensor 5 (FIG. 11(*c*)), the noise in the signal detected by the optical sensor is removed by the noise-removing circuit 33 (FIG. 11(*d*)) and thereafter supplied to the timer circuit 34. The timer circuit 34 does not, however, operate since the light level is detected. However, in the state where the power is supplied and the light is blocked when the good 3 is stolen, the blockage of the light is detected by the optical sensor 5 (FIG. 11(*c*)). The blockage of the light, namely, the darkness of the light level continues for a predetermined time, the timer circuit 34 operates to provide a signal "1" to the drive circuit 37 (FIG. 11(*e*)). Whereupon, the transistor Tr5 of the drive circuit 37 is turned on and successively the transistor Tr4 of the drive circuit 37 is turned on to thereby allow the buzzer 15 to keep sounding thereafter irrespective of any state set forth above (FIG. 11(*b*)). The theft can be detected by the sound of the buzzer 15.

Figure 13:
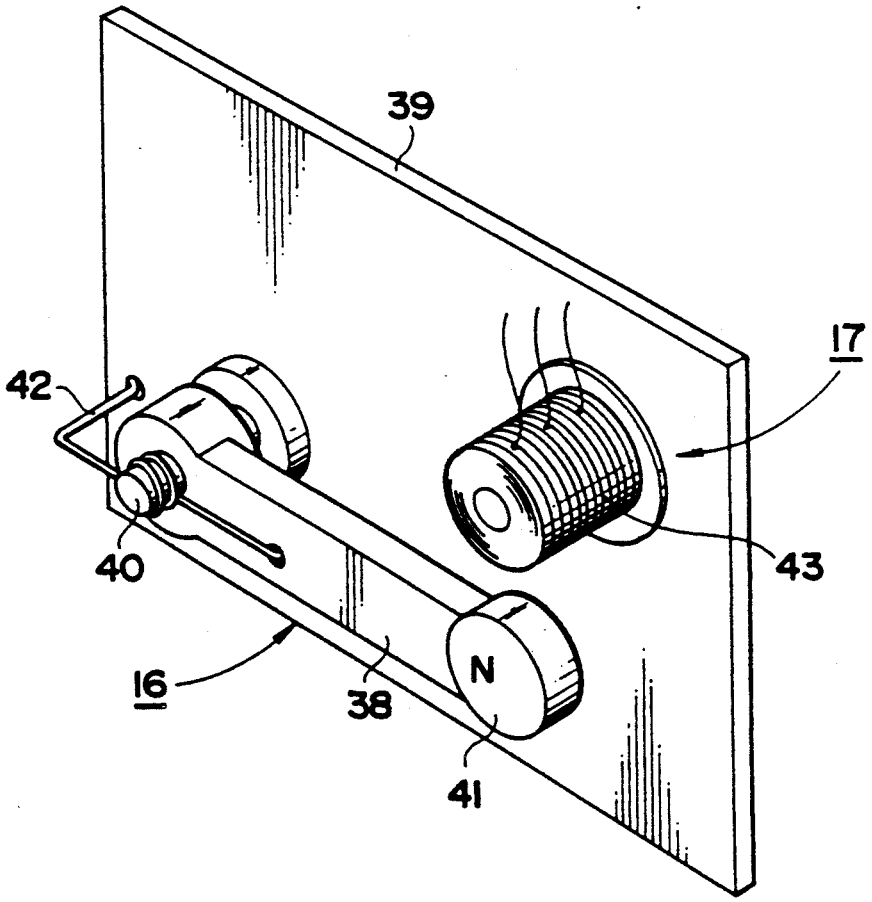
FIG. 13 is an enlarged perspective view showing a modified vibration sensor employed in a theft prevention device according to a fourth embodiment of the present invention.
Figure 14:
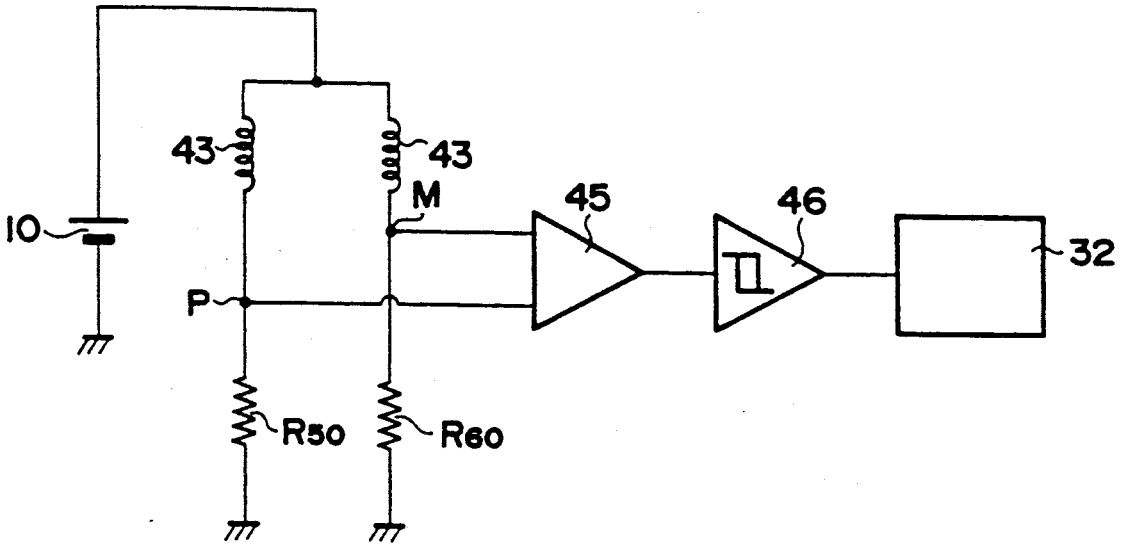
FIG. 14 is a circuit diagram of a detecting circuit employed in an arrangement of FIG. 13.

Fourth Embodiment (FIGS. 13 and 14)

A theft prevention device provided with a modified vibration sensor according to the fourth embodiment of the present invention will be described with reference to FIGS. 13 and 14.

Elements constituting the theft prevention device which are the same as those in the first to third embodiments have the same numerals.

The vibration sensor 13 includes a movable body 16 composed of a shaft 40 fixed on a base 39, a stick-like plate 38 rotatably and pivotally mounted on the shaft 40 at one end thereof, a magnetic body 41 mounted at the other end of the stick-like plate 38 and a coil spring 42 for urging the stick-like plate 38 to a predetermined position, and a detecting body 17 having a detecting coil wound therearound which is positioned along the radius of the magnetic body 41 along which the magnetic body 41 moves. When the magnetic body 41 crosses the detecting coil 43, an electromotive force is generated in the detecting coil 43 whereby the vibration can be detected.

FIG. 14 shows a circuit diagram of the arrangement of the detecting circuit. The detecting coil 43 is divided into two portions and a middle point Cm thereof is connected to an anode of the mini cell 10. Other terminals P, M of the divided detecting coils 43 are grounded via resistors R50, R60 and connected to input terminals of a differential amplifier circuit 45. An output terminal of the differential amplifier circuit 45 is connected to an input terminal of a Schmitt trigger circuit 46. An output terminal of the Schmitt trigger circuit 46 is connected to an input terminal of the vibration signal processing circuit 32.

Figure 15:
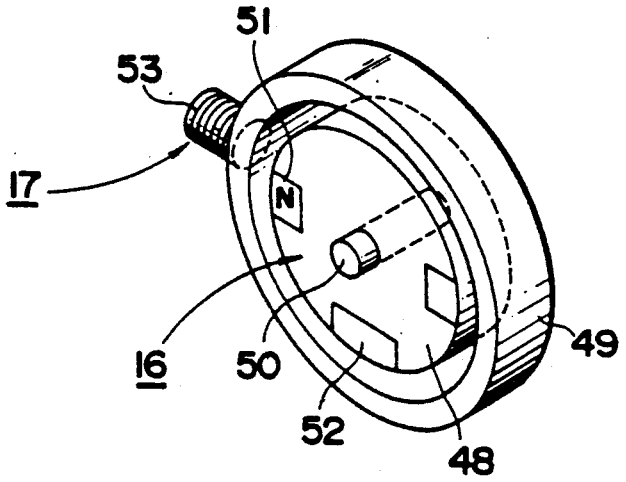
FIG. 15 is an enlarged perspective view showing a further modified vibration sensor employed in a theft prevention device according to a fifth embodiment of the present invention.

Fifth Embodiment (FIG. 15)

A theft prevention device provided with another modified vibration sensor is illustrated in FIG. 15.

The vibration sensor 13 includes a movable body 16 composed of a base 49 serving as a cover, a shaft 50 implanted on the base 49, a disk 48 rotatably and pivotally mounted on the shaft 50, magnetic bodies 51 provided at the periphery of the disk 48, a weight 52 provided at the periphery of the disk 48 for varying the gravity position of the disk 48 to thereby allow the magnetic bodies 51 to be returned to a predetermined position at all times, and a detecting body 17 composed of a detecting coil 53 provided on the cover of the base 49.

The circuit diagram as illustrated in FIG. 14 is also used in the arrangement of the modified vibration sensor of FIG. 15.

As is evident from the above mentioned description, according to the theft prevention device of the third to fifth embodiments of the present invention, the alarm is sounded at the occurrence of a theft when the vibration sensor 13 detects the vibration and a predetermined time is lapsed after the detection of the change of the light level by the optical sensor 5 from brightness to darkness, or when the micro switch 4 detects the removal of the good 3 from the transparent case 2. As a result, the theft can be detected with certainty and a device emitting a powerful electromagnetic wave is not necessitated. Furthermore, the resonator for detecting the electromagnetic wave is not necessitated to thereby reduce the size of the theft prevention device. Still furthermore, the vibration sensor having a simple structure can detect the vibration with certainty.

Sixth Embodiment (FIGS. 16 to 22)

A theft prevention device according to the sixth embodiment of the present invention will be described with reference to FIGS. 16 to 22.

Elements constituting the theft prevention device which are the same as those in the first to the fifth embodiments have the same numerals.

Figure 16:
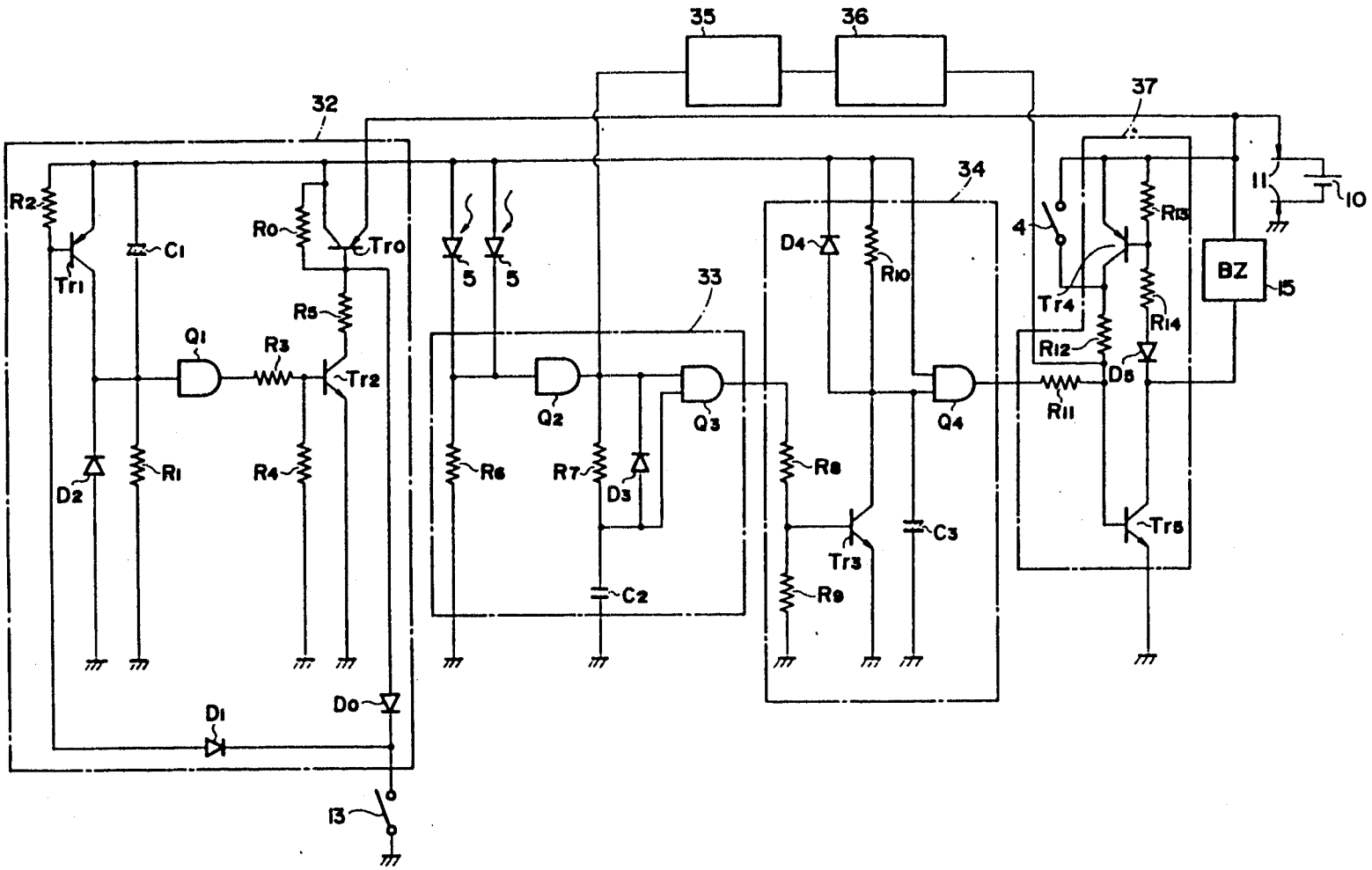
FIG. 16 is a circuit diagram showing an arrangement of a theft prevention device according to a sixth embodiment of the present invention.

A circuit diagram shown in FIG. 16 includes a vibration signal processing circuit 32 for processing a signal detected by the vibration sensor 13, a noise-removing circuit 33 for removing the frequency component, for example, a frequency of at least 150 Hz, from the signal of the optical sensor 5, a timer circuit 34 for providing a signal when the noise-removing circuit 33 provides the signal for a given time, a high-pass filter 35 for filtering only a signal having a predetermined frequency, for example, the frequency of at least 150 Hz, a second timer circuit 36 for providing a signal "1" when the signal provided by the high-pass filter 35 continues for a predetermined time (for example, for 0.5 seconds) and a drive circuit 37 for receiving the signals provided by the timer circuits 34, 36 or the signal provided by the micro switch 4 and having the buzzer 15.

The arrangement of the vibration signal processing circuit 32, the noise-removing circuit 33 and the timer circuit 34 are the same as those of the third embodiment.

The drive circuit 37 includes a buzzer switch circuit composed of an input resistor R11 and a driving transistor Tr5, and a holding circuit composed of resistors R12 to R14, a transistor Tr4 and a diode D4 for keeping the buzzer switch circuit turned on.

The drive circuit 37 receives a signal provided by the optical sensor 5 on the reception of an output from the amplifier circuit Q2 of the noise-removing circuit 33 and provides a signal "1" when the signal from the optical sensor 5 exceeds a predetermined frequency, for example, 150 Hz.

The second timer circuit 36 provides a signal "1" when the signal "1" provided by the high-pass filter 35 continues over a predetermined time, for example 0.5 seconds.

Figure 17:
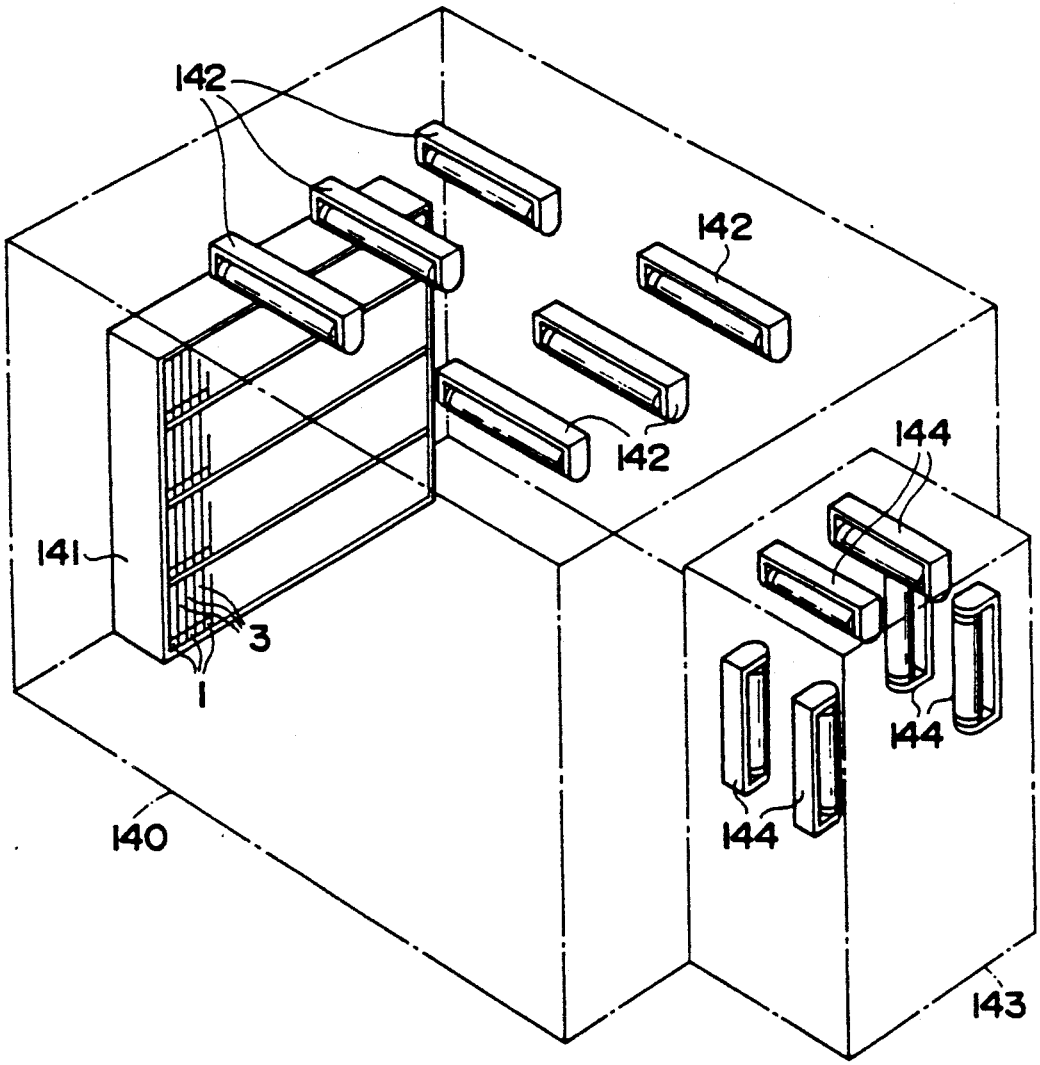
FIG. 17 is a view of assistance in explaining facilities accommodating the device of FIG. 16.

FIG. 17 shows an arrangement of facilities where the theft prevention device 1 is placed on a showcase 141 in a building 140.

A plurality of devices 1 accommodating the plurality of the good 3 are disposed on the showcase 141. The plurality of the goods 3 are illuminated by fluorescent lamps 142 provided on the ceiling of the building 140. The fluorescent lamps 142 are operated by an alternating current power source of a commercial frequency. The entrance and exit 143 of the building 140 are lighted by a plurality of fluorescent lamps 144 provided on the ceiling and the side surfaces of the building 140. The fluorescent lamps 144 are operated by an alternating current power supplied by an inverter of 1 KHz (not shown).

Figure 18:
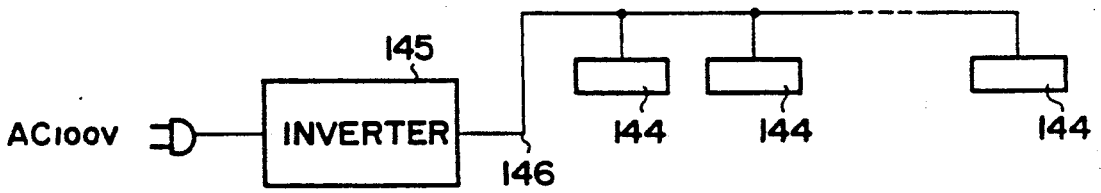
FIG. 18 is a block diagram of an electric circuit employed in the facilities of FIG. 17.

FIG. 18 is a block diagram of the facility. The inverter 145 receives the alternating current (100V) having the commercial frequency and converts the alternating current into the power source having a high frequency, for example 1 KHz, so that the fluorescent lamps 144 connected to the output of the inverter 145 are illuminated.

An operation of the theft prevention device 1 thus structured will be described with reference to FIGS. 17 to 21(B).

Figure 19:
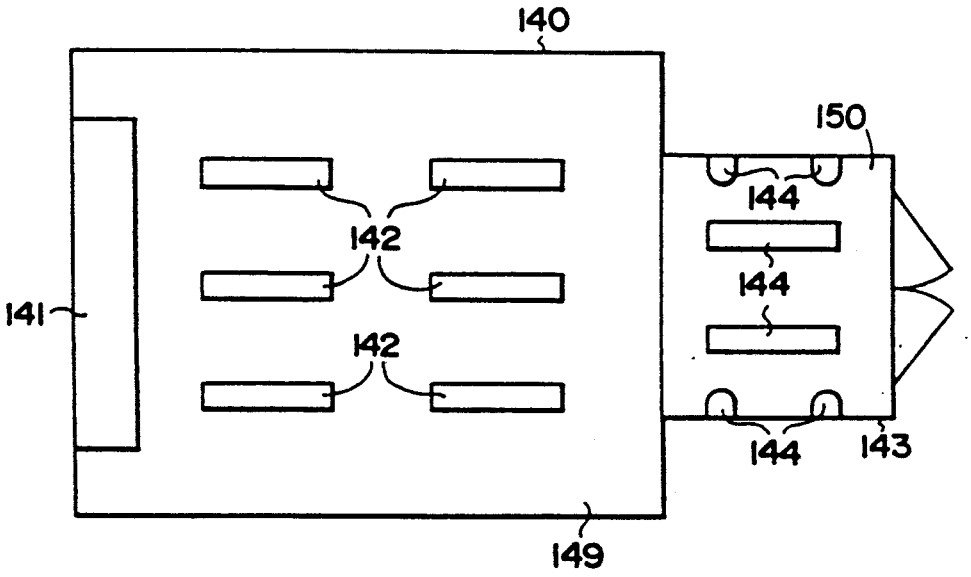
FIG. 19 is a view of assistance in explaining illuminating areas in the facilities of FIG. 17.

FIG. 19 shows the area where the fluorescent lamps light wherein the area denoted at 149 is lighted by the fluorescent lamps 142 and the area 150 is lighted by the fluorescent lamps 144 which are driven by the inverter 145.

Figure 20:
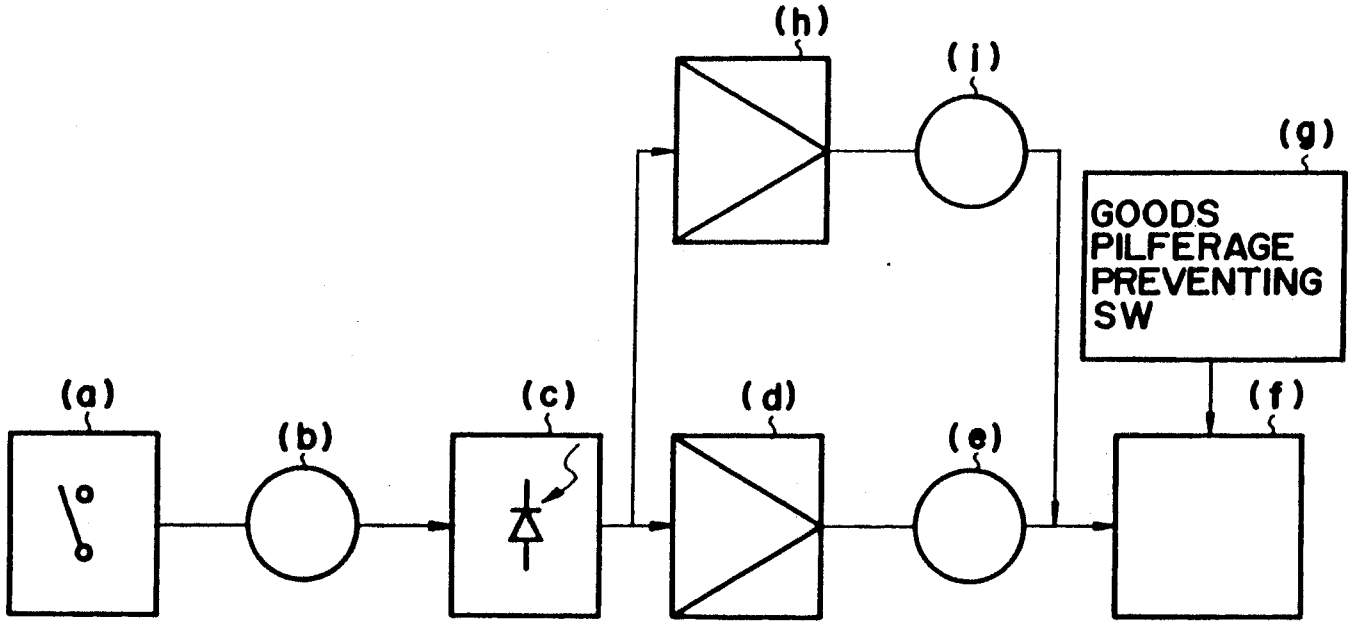
FIG. 20 is a view of assistance in explaining an operation of the arrangement of the device of FIG. 16.
Figure 21A:
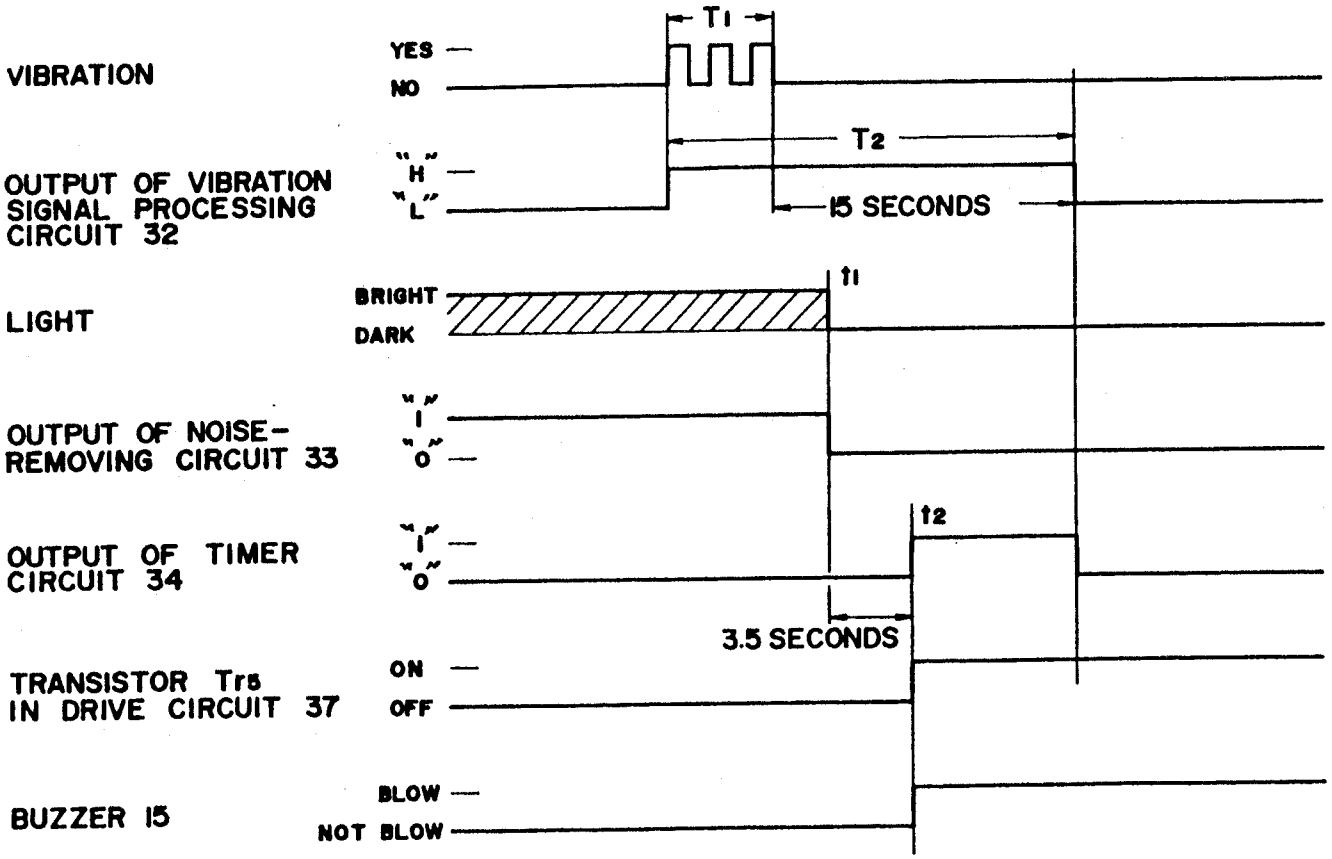
FIGS. 21(A), 21(B) are timing charts showing an operation of the arrangement of the device of FIG. 16.
Figure 21:
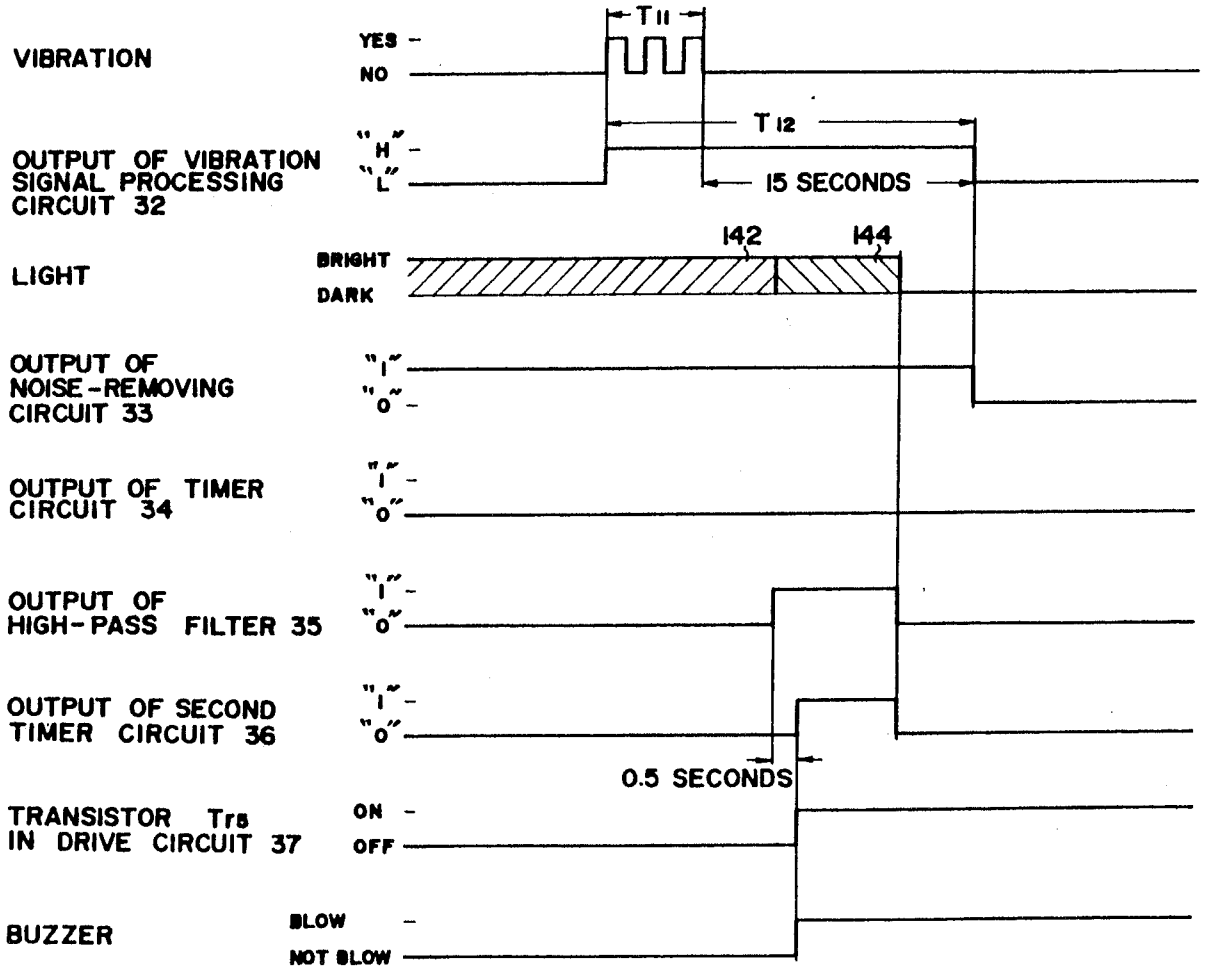
Figure 22:
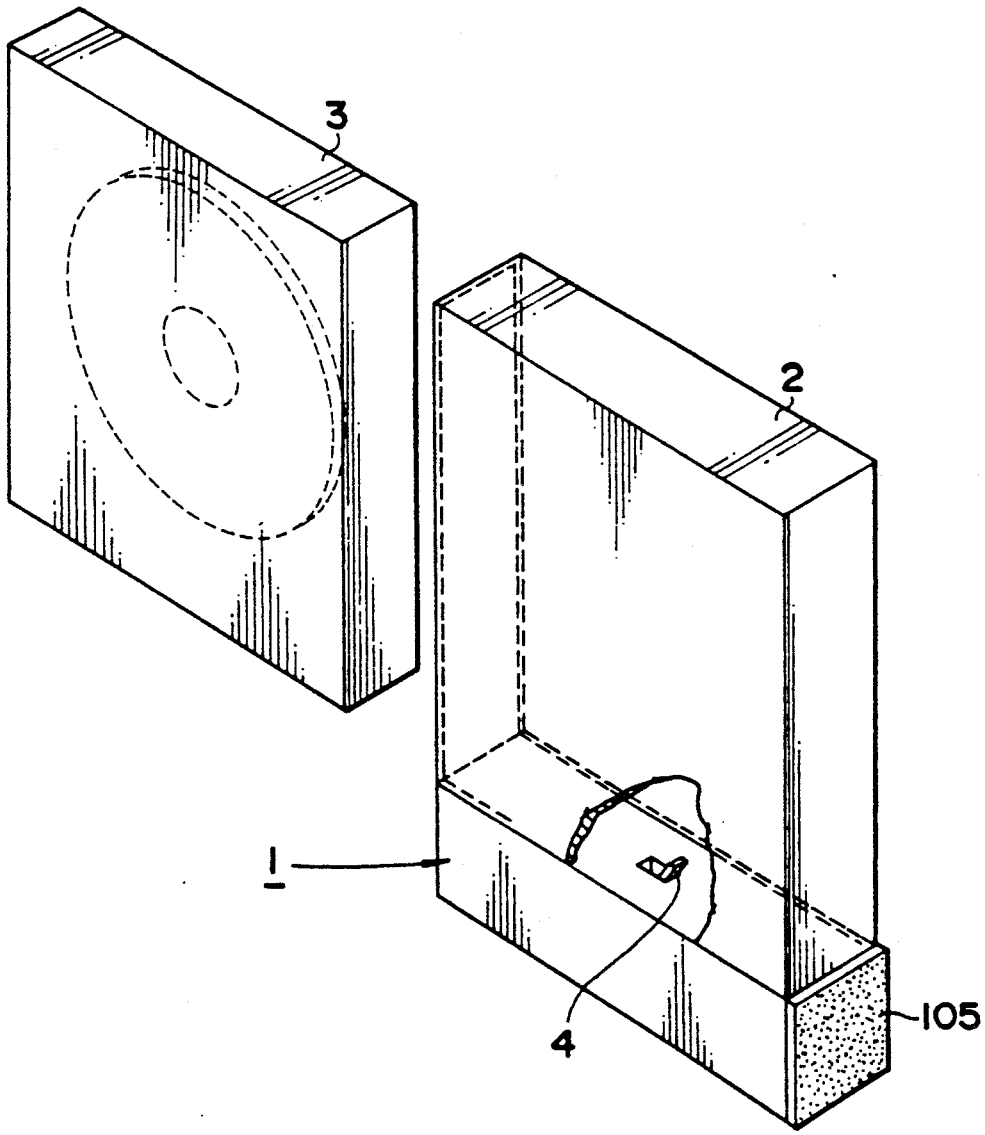
FIG. 22 is a perspective view of a theft prevention device according to a seventh embodiment of the present invention.
Figure 23:
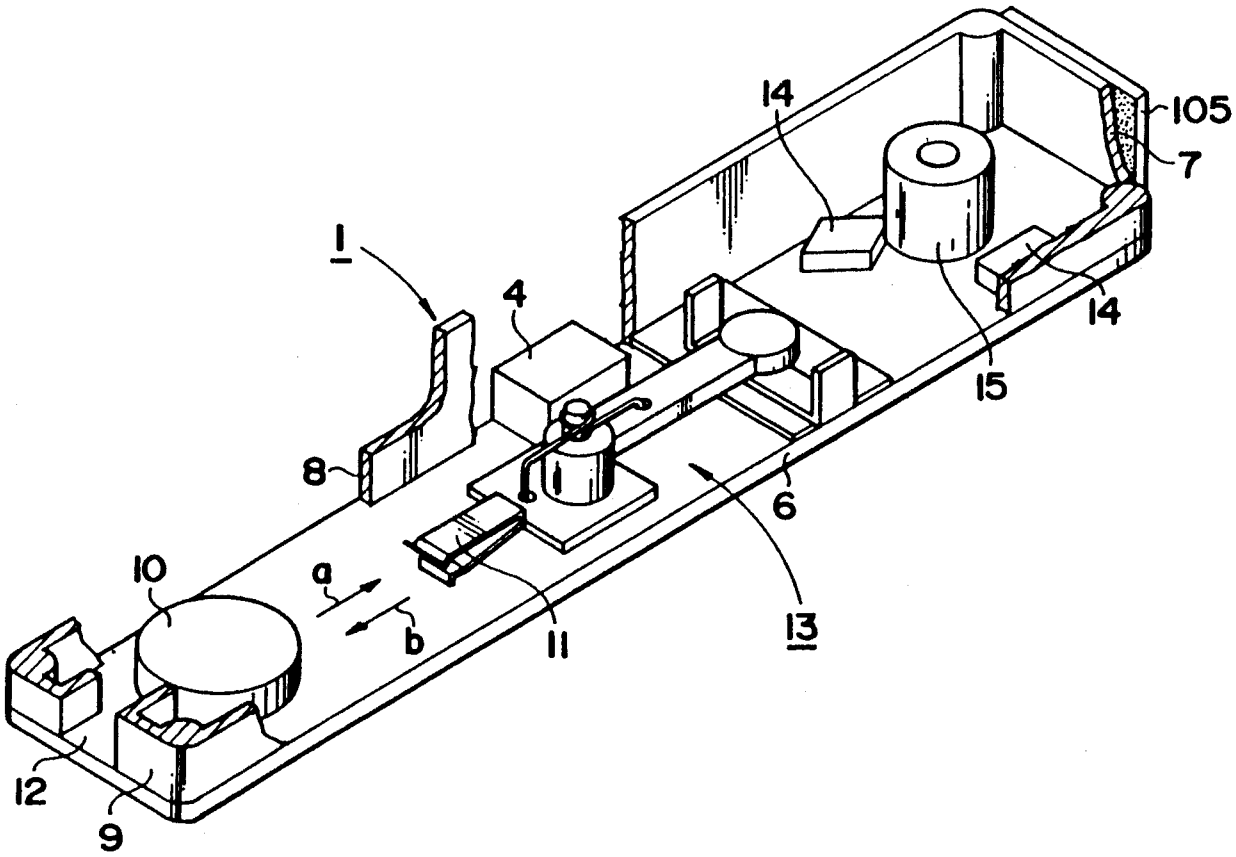
FIG. 23 is a diagram showing an arrangement of FIG. 22.

FIG. 20 shows a view for explaining an operation of the device 1. FIGS. 21(A) and 21(B) are time charts showing the operation of the device 1.

In the case where the device 1 is in a motionless state, the vibration sensor 13 is turned off, hence the transistor Tr0 is turned off. Accordingly, no power is supplied from the mini cell 10 to the vibration signal processing circuit 32, the noise-removing circuit 33 and the timer circuit 34. Hence, these circuits do not operate.

When the good 3 is removed from the transparent case 2, the micro switch 4 is turned on and the transistor Tr5 is maintained in an on state by the holding circuit composed of the resistors R12 to R14, the transistor Tr4 and the diode D4. Hence, the buzzer 15 is kept sounding even if the good 3 is returned to the transparent case 2 (FIGS. 20(*g*), (*f*)).

Suppose that the good 3 is stolen in a manner where the good 3 is accommodated in the transparent case 2 and is placed in a pocket. Vibration occurs normally in such a situation. When the vibration is detected by the vibration sensor 13 (FIG. 20(*a*), T1 in FIG. 21(A)), the transistor Tr0 is turned on so that the power is supplied from the mini cell 10 to the vibration signal processing circuit 32 and the associated circuits. At the same time, the transistor Tr1 is turned on. Thereafter, the vibration signal processing circuit 32 continuously provides the signal "1" for a given time (e.g. 15 seconds) immediately after the vibration sensor 13 is turned off. Whereupon, the transistor Tr2 is turned on and the transistor Tr0 is successively turned on whereby the power is continuously supplied to the vibration signal processing circuit 32, the associated circuits (FIG. 20(*b*), time T2 in FIG. 20(A)). At this state, when the light is detected by the optical sensor 5 (FIG. 20(*c*)), a noise of the detected signal is removed by the noise-removing circuit 33 (FIG. 20(*d*)), and the detected signal having no noise is supplied to the timer circuit 34 which does not however operate because the light is detected. However, if the good 3 is stolen and the light blocked in this state where the power is supplied to the circuit, the blockage of the light is detected by the optical sensor 5 (FIG. 20(*c*), t1 in FIG. 21(A)). In the case where the blockage of the light, namely, the darkness continues for a given time (3.5 seconds in FIG. 21(A)), the timer circuit 34 operates so that the signal "1" is given to the drive circuit 37 (FIG. 20(*e*), t2 in FIG. 21(A)). Whereupon, the transistor Tr5 in the drive circuit 37 is turned on and successively the transistor Tr4 is turned on, and thereafter irrespective of the state set forth above, the buzzer 15 is kept sounding (FIG. 20(*f*), after t2 in FIG. 21(A)).

Suppose that the good 3 is stolen in a manner where the good is accommodated in the transparent case 2 and the good is exposed to the light. Vibration occurs normally in such a situation. When the vibration is detected by the vibration sensor 13 (FIG. 20(A), T1 in FIG. 21(B)), the transistor Tr0 is turned on so that the power is supplied from the mini cell 10 to the vibration signal processing circuit 32 and the associated circuits. At the same time, the transistor Tr1 is turned on. Thereafter, the vibration signal processing circuit 32 continuously provides the signal "1" for a given time (e.g. 15 seconds) immediately after the vibration sensor 13 is turned off. Whereupon, the transistor Tr2 is turned on and the transistor Tr0 is successively turned on whereby the power is continuously supplied to the vibration signal processing circuit 32 and the associated circuit 34 (FIG. 20(*b*), time T12 in FIG. 20(B)). At this state where the power is supplied to the circuits, when the optical sensor 5 is exposed to the light at the area 149 (FIG. 20(*c*)), the noise of the detected signal is removed by the noise-removing circuit 33 (FIG. 20(*d*)) and the detected signal having no noise is supplied to the timer circuit 34. However, the timer circuit 34 does not operate because the light is detected.

At this state, if a person having the good moves from the lighted are 149 to the entrance and exit 143 and then comes to the light area 150, the optical sensor 5 detects the light of the fluorescent lamps 144 which is driven by the alternating current having 1 KHz (FIG. 20(*c*), t11 in FIG. 21(B)). A signal "1" is provided by the high-pass filter 35 during the period when the optical sensor 5 detects the fluorescent lamps 144 (FIG. 20(*h*), t11 in FIG. 21(B)). The output signal "1" is continuously provided from the high-pass filter 35 for a predetermined time (0.5 seconds in FIG. 21(B)) so that the second timer 36 operates to provide a signal "1" to the drive circuit 37 (FIG. 20(*i*), t12 in FIG. 21(B)). As a result, the transistor Tr5 in the drive circuit 37 is turned on and successively the transistor Tr4 is turned on to thereby thereafter sound the buzzer 15 irrespective of the state set forth above. (FIG. 20(*f*), after t12 in FIG. 21(B)).

As mentioned above, the theft can be identified by the buzzer sound.

There are the following advantages according to the theft prevention device of the sixth embodiment.

It is possible to prevent theft with assurance since the alarm is sounded when the light having the prescribed frequency is detected by the optical sensor at the time when the vibration sensor detects the vibration.

It is possible to prevent the theft with more assurance since the alarm is sounded when the light having the prescribed frequency is detected in the case where the vibration sensor detects the vibration irrespective of the interception of the light.

It is possible to eliminate the device of the prior art for emitting a powerful electromagnetic wave and a resonator for detecting the electromagnetic wave since the facilities provided the theft prevention device of the sixth embodiment is lighted at the prescribed frequency.

Seventh Embodiment (FIGS. 22 to 28)

A theft prevention device according to a seventh embodiment will be described with reference to FIGS. 22 to 28.

Elements constituting theft prevention device which are the same as those in the first to the sixth embodiments have the same numerals.

The arrangement of the theft prevention device is the same as that of the third embodiment except that the former is provided with a solar cell serving as the optical sensor and an optical signal processing circuit. That is, the device includes a micro switch 4, the solar cell 105, an alarm circuit 30 and the optical signal processing circuit 133. The solar cell 105 is structured to generate a power source upon the reception of light. The vibration sensor 13 is structured to convert a vibration signal issued by the vibration of the good into an electric signal. The micro switch 4 electrically detects the removal of the good from the transparent case 2. The optical signal processing circuit 133 receives an optoelectronic voltage from the solar cell 105 for supplying power to the signal processing circuit 31 and charging the cell 10. The alarm circuit 30 includes the signal processing circuit 31 and the buzzer 15. The alarm circuit 30 receives an optical signal indicative of the presence of light provided by the optical signal processing circuit 133, a vibration signal provided by the vibration sensor 6 and a switching signal provided by the micro switch 4 for driving the buzzer when these devices meet the prescribed condition. For example, the signal processing circuit 31 supplies the power to the circuits for a predetermined time at the time of detection of the vibration by the vibration sensor 13 and sounds the buzzer 15 when the optical signal provided by the solar cell 105 and the optical signal processing circuit 133 indicate a change of the light level from brightness to darkness and a predetermined time has lapsed. Alternatively, the signal processing circuit 31 supplies the power directly to the buzzer 15 for sounding the buzzer 15 when the micro switch 4 detects the removal of the good 3 from the transparent case 2.

Figure 25:
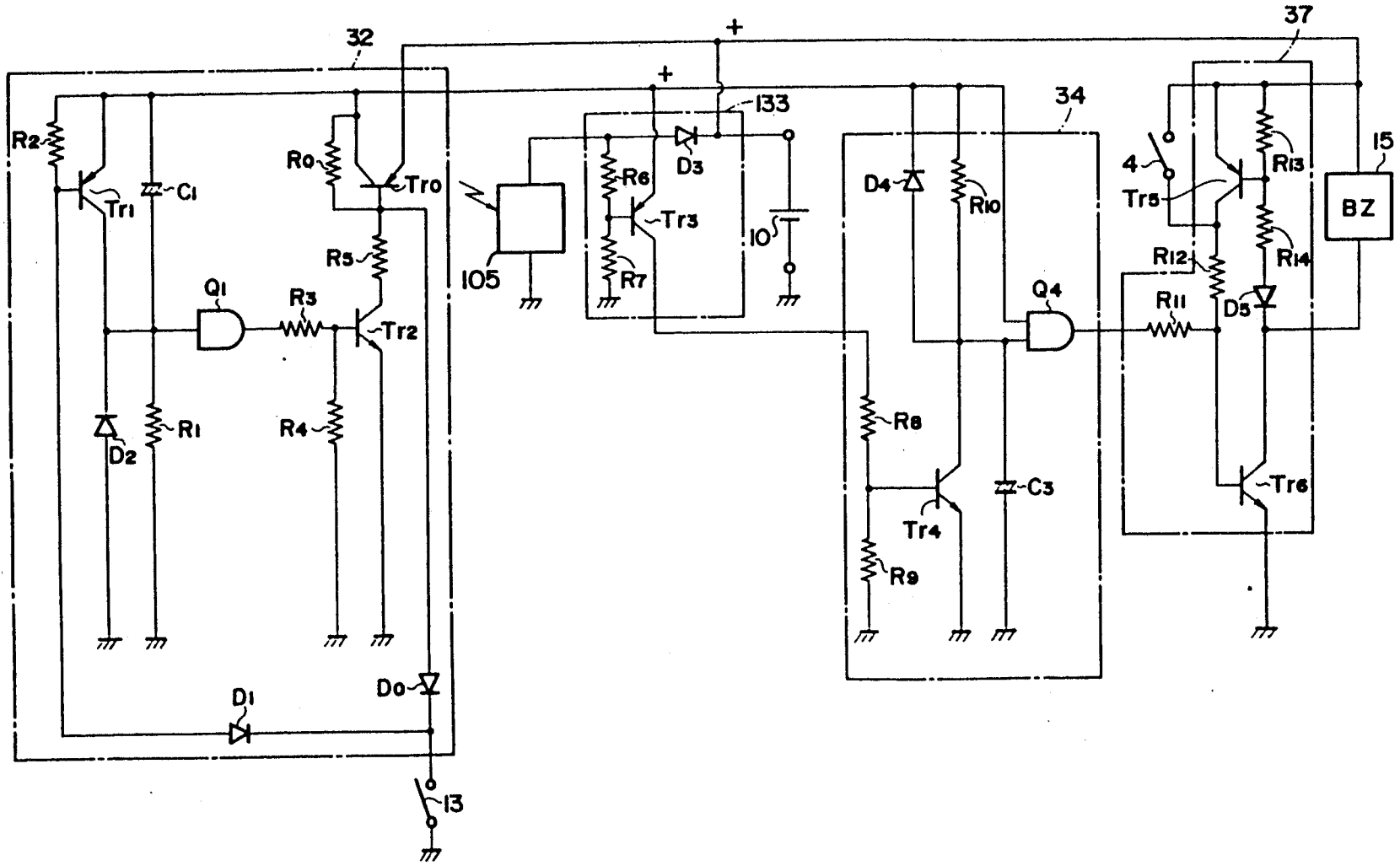
FIG. 25 is a circuit diagram showing the arrangement of FIG. 22.

FIG. 25 shows a circuit diagram of the signal processing circuit 31.

The signal processing circuit 31 includes the vibration signal processing circuit 32 for processing the signal provided by the vibrator 13, the optical signal processing circuit 133 for effecting a floating charge by way of an optoelectronic voltage and interlocking with the optical sensor, the timer circuit 34 for providing an output signal when the signal provided by the optical processing signal circuit 133 continues for a prescribed time and the drive circuit 35 for receiving the signal provided by the timer circuit 34 or the switching signal provided by the micro switch 4 for driving the buzzer 15.

The arrangement of the vibration signal processing circuit 32 is same as that of the sixth embodiment as illustrated in FIG. 16.

The optical signal processing circuit 133 includes a floating charging portion for supplying the optoelectronic voltage of the solar cell 105 to the cell 10 through the inverse prevention diode D3 and a detecting circuit composed of a transistor Tr3 and resistors R6, R7. The detecting circuit provides an output signal "1" to the timer circuit 34 when the dividing voltage of the resistors R6, R7 which cut off the transistor Tr3 is lost to thereby turn on the transistor Tr3 at the time when the optoelectronic voltage is not applied thereto from the solar cell 105.

The timer circuit 34 includes an input amplifier portion composed of input resistors R8, R9 for dividing the output signal from the optical signal processing circuit 133 and a transistor Tr4 to be turned on by the divided signal and a delay circuit composed of a resistor R10, a diode D4, a capacitor C3 and an AND circuit Q4. When the input is "1" after the lapse of a prescribed time, e.g. 3.5 seconds, an output from the AND circuit Q4 is supplied to the drive circuit 37.

The drive circuit 37 includes a buzzer switching circuit composed of an input resistor R12 and driving transistor Tr6 and a holding circuit composed of resistors R12 to R14, a transistor Tr5 and a diode D4 for continually turning on the buzzer switching circuit.

An operation of the theft prevention device having such a structure according to the seventh embodiment will be described with reference to FIGS. 22 to 27.

In the case where the device 1 is in a motionless state, the vibration sensor 13 is turned off and the transistor Tr0 is turned off. Hence, the power is not supplied from the cell 10 to the vibration signal processing circuit 32, the noise-removing circuit 33 and the timer circuit 34 so that the circuits do not operate. At this time, when light is received by the solar cell 105 the optoelectronic voltage is generated by the solar cell 105. As a result, current flows from one of the electrodes of the solar cell 105 to the diode D3, to an anode of the cell 10, to a cathode of the cell 10, and to another electrode of the solar cell 105, for thereby charging the cell 10. When the solar cell 105 does not receive light, the optoelectronic voltage is not generated in the solar cell 105 so that current does not flow from the cell 10 to the solar cell 105 due to the inverse current prevention diode D3.

When the good 3 is removed from the transport case 2 of the device 1 the micro switch 4 is turned on and the transistor Tr5 is maintained on by the holding circuit composed of the resistors R12–R14, the transistor Tr4 and the diode D4. Accordingly, the buzzer 15 continues to sound even if the good 3 is returned to the transparent case 2 (FIG. 26(*g*), (*f*)).

When the good 3 is stolen in a manner where it is accommodated in the transparent case 2, the micro switch 4 does not operate since the good 3 is still accommodated in the transparent case 2. Assume that the good 3 is placed in a pocket. The action of placing the good in the pocket is accompanied by vibration. The vibration is detected by the vibration sensor 13 (FIG. 26(*a*), t1 in FIG. 27) and the transistor Tr0 is turned on so that the vibration signal processing circuit 32 provides an "H" level output (at the state of supplying power) whereby the power is supplied from the cell 10 to the vibration signal processing circuit 32, the optical signal processing circuit 133 and the timer circuit 34. Simultaneously, the vibration signal processing circuit 32 continues to provide the "H" level output (the power from the cell 10) for a predetermined time (e.g. 15 seconds from the time t2) counting from the time when the transistor Tr1 is turned on and successively the vibration sensor is turned off (t2 in FIG. 27) (t2 to t5 in FIG. 27).

Figure 26:
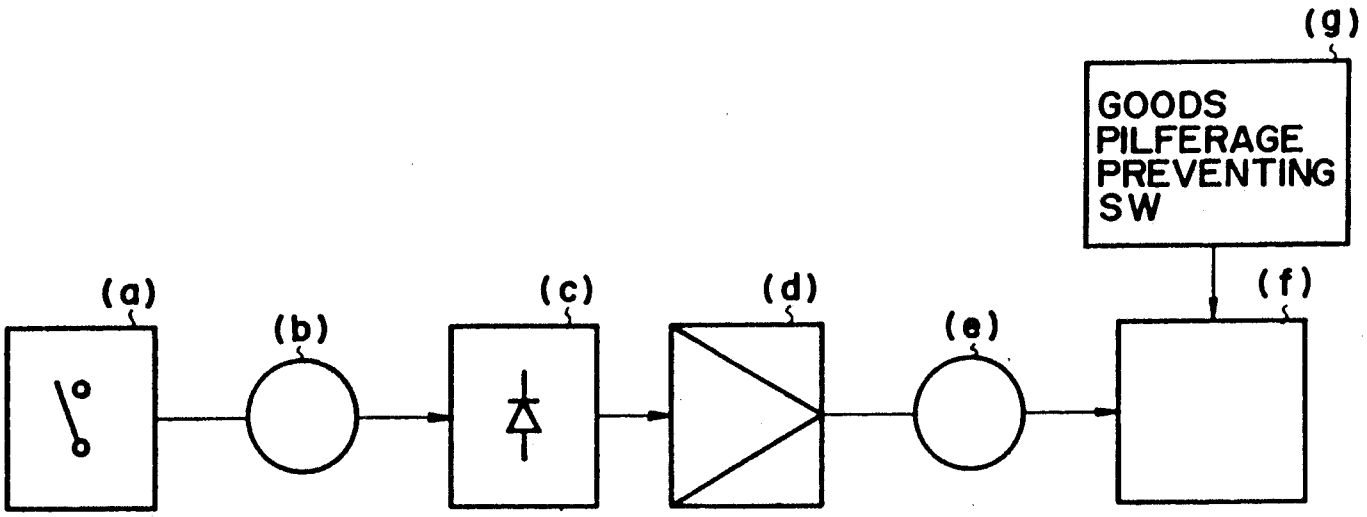
FIG. 26 is a view of assistance in explaining an operation of the arrangement of FIG. 22.
Figure 27:
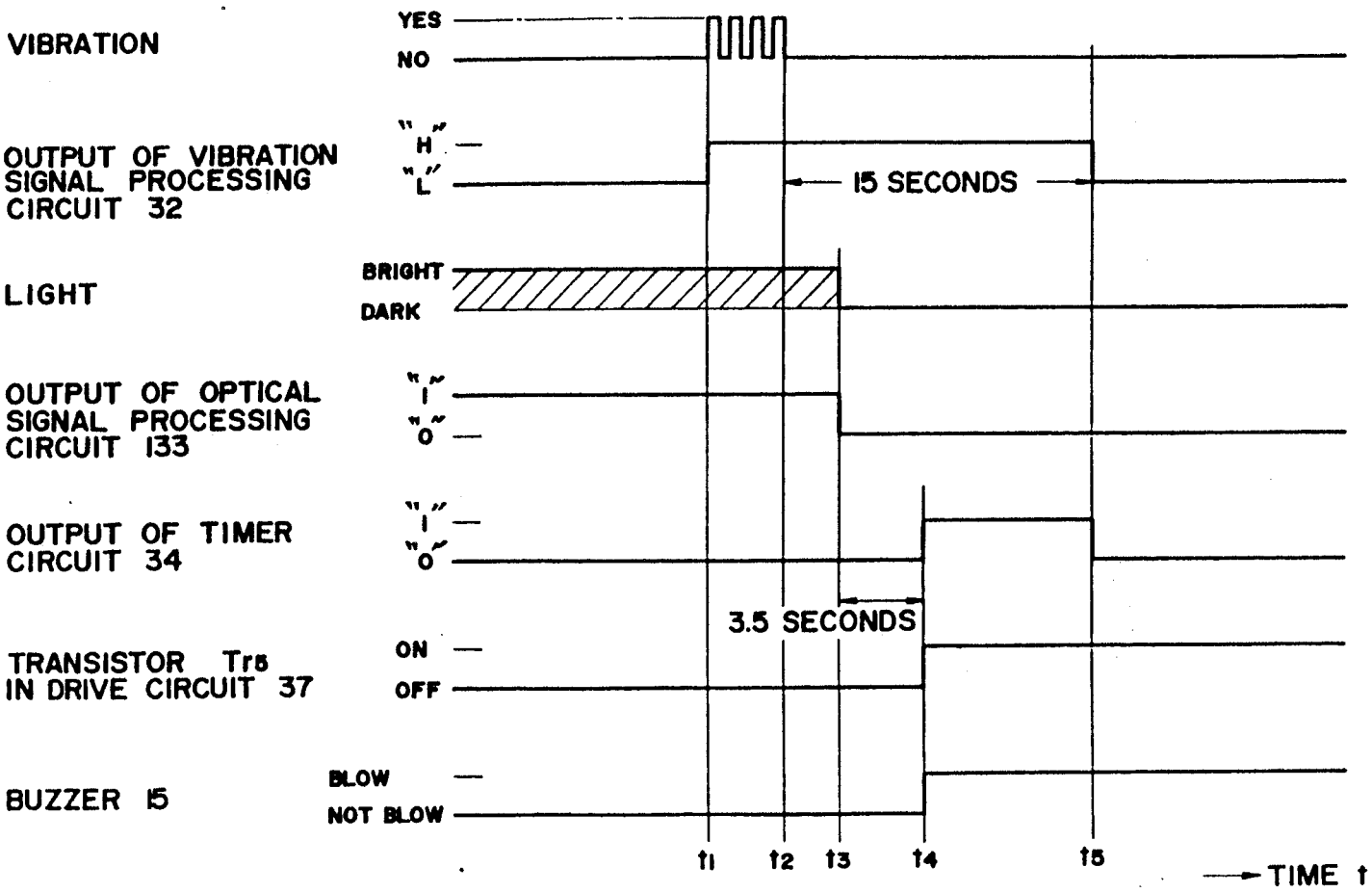
FIG. 27 is a timing chart showing an operation of the arrangement of FIG. 22.

At this state, inasmuch as the optoelectronic voltage is supplied from the solar cell 105 to the optical signal processing 133 when the solar cell 105 receives light (FIG. 26(*c*), before t3 in FIG. 27), the transistor Tr3 is turned off so that the signal "0" is provided by the optical signal processing 133 (FIG. 26(*d*), t1 to t3 in FIG. 27) and supplied to the timer circuit 34. Consequently, the timer circuit 34 does not operate.

Figure 6:
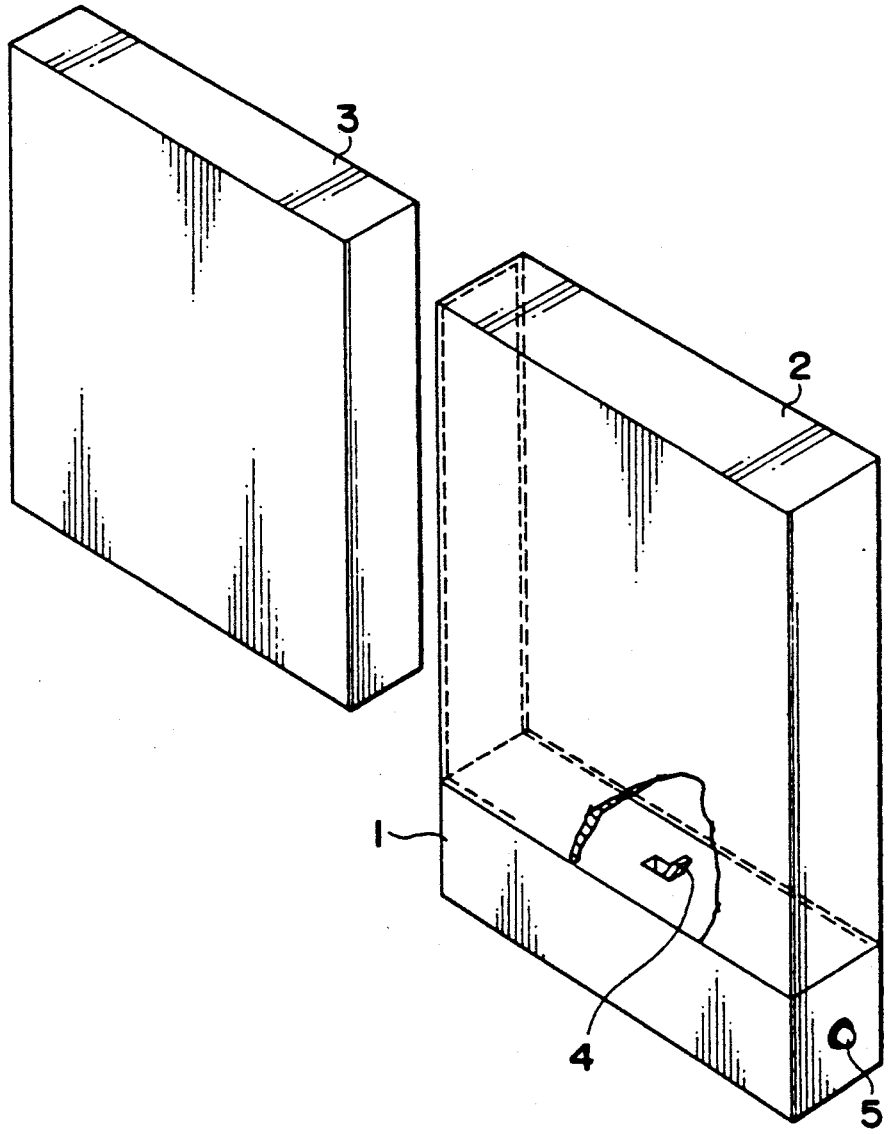
FIG. 6 is a perspective view of a theft prevention device according to a third embodiment of the present invention.

However, in the case where the light is blocked due to the theft when the power is supplied to the vibration signal processing circuit 32, the optical signal processing circuit 133 and the timer circuit 34 the optoelectronics voltage is not generated by the solar cell 105 (FIG. 6(*c*)). As a result, the cutoff bias of the resistors R6, R7 is not generated since no power is supplied from the solar cell 105 to the optical signal processing circuit 133 so that the transistor Tr3 is turned on whereby the optical signal processing circuit 133 provides the signal "1" (after t3 in FIG. 27). The optical signal processing circuit 133 continues to provide the signal "1" for a period of blockage of the light (t3 in FIG. 27).

In the case where the state of darkness (the state where the signal "1" is provided by the optical signal processing circuit 133) is detected for a prescribed time (e.g. 3.5 seconds for the period t3 to t4 in FIG. 27), the timer circuit 34 operates to provide the signal "1" to the drive circuit 37 (FIG. 26(e), t4 in FIG. 27). As a result, the transistor Tr6 in the drive circuit 37 is turned on and successively the transistor Tr5 is turned on to thereby thereafter permit the buzzer 15 to keep sounding irrespective of the state set forth above (FIG. 26(*b*), t4 in FIG. 27).

When 15 seconds has elapsed (t5 in FIG. 27) after the vibration is not detected (t2 in FIG. 27), the vibration signal processing circuit 32 provides an "L" output (the state where no power is supplied) so that both the optical signal processing circuit 133 and the timer circuit 34 provides the signal "0". However, the drive circuit 37 remains operative (after t4 in FIG. 27).

Figure 28:
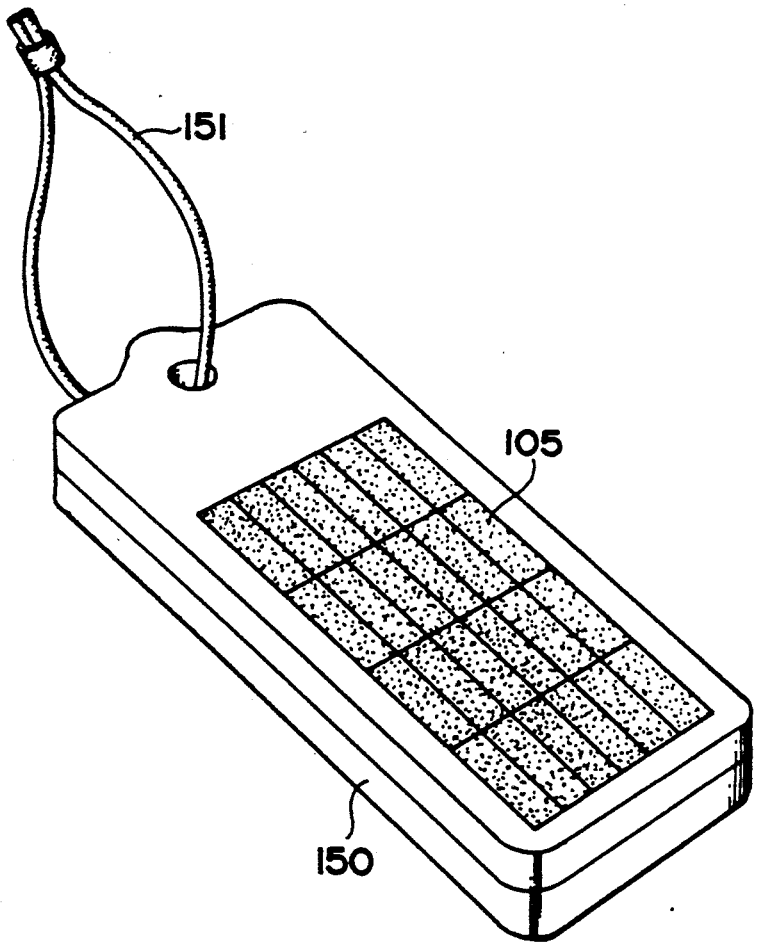
FIG. 28 is a perspective view of a theft prevention device according to an eighth embodiment of the present invention.

Eighth Embodiment (FIG. 28)

A theft prevention device according to the eighth embodiment will be described with reference to FIG. 28.

Figure 24:
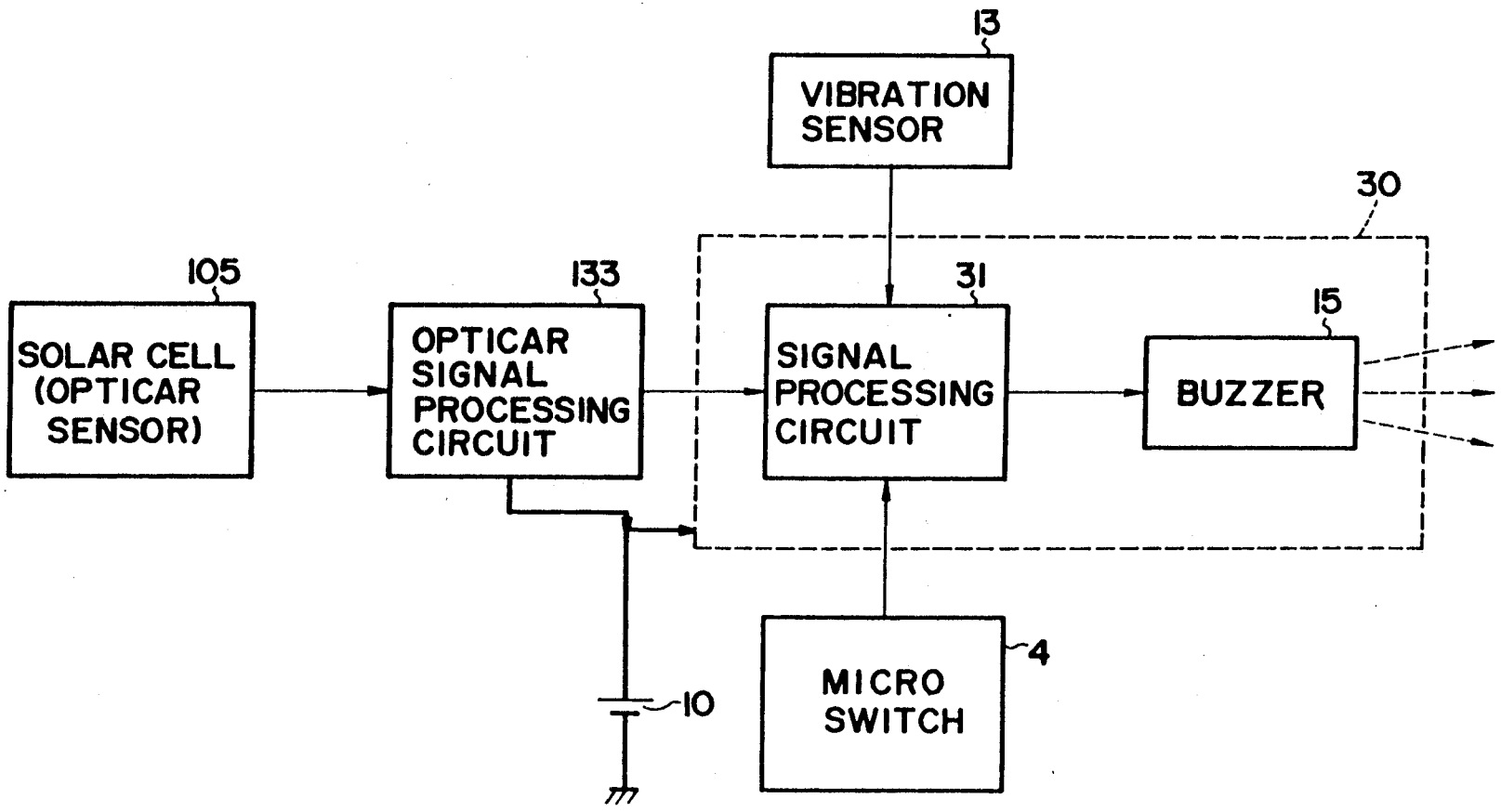
FIG. 24 is a block diagram showing the arrangement of FIG. 22.

The device 1 is different from that of the seventh embodiment in that the arrangement as illustrated in FIG. 24 is incorporated into the tag 150. That is, the solar cells 105 are attached to the surface of the tag 150 and the vibration sensor 13, the alarm device 30 and the optical signal processing circuit 133 are incorporated into the tag 50. An attaching cord 151 of the tag substituted for the micro switch 4 is made of a conductive member and designed so that the micro switch detects the cutting of the attaching cord 151 and provides the signal indicative of the cutting of the attaching cord 151. The device 1 having this structure functions the same as the device 1 of the seventh embodiment.

The device 1 of the eighth embodiment sounds the alarm when the vibration sensor 13 detects the vibration and the light level is varied from brightness to darkness and a prescribed time is lapsed, or when the good is removed from the transparent case 2. Hence, the theft is prevented with certainty. As a result, the device of the prior art for emitting a powerful electromagnetic wave is not necessitated and the resonator for detecting the electromagnetic wave is not necessitated so that the size of the device can be reduced.

When light is received by the solar cell 105, the cell 10 can be prevented from being consumed excessively since the cell is charged by the solar cell 105 so that the operation of the theft prevention device can be assured. Although the solar cell is used as the power supply for supplying the power to the cell 10, any device capable of generating power using light can be employed instead of the solar cell 105.

According to the theft prevention device of the seventh and the eighth embodiments, the cell is charged by the optoelectronic voltage of the optoelectronic element when light is received by the optoelectronic element whereby the excessive consumption of the cell can be prevented and the reliable operation is assured since the cell can be used at all times. As a result, it it possible to prevent not only a frequent check of the cell but also the non-operation of the device due to the consumption of the cell when the power is supplied to all the circuits during each operation of the circuits.

The number of elements can be reduced since the optoelectronic element serves also as the optical sensor.

Ninth Embodiment (FIGS. 29 to 37)

A theft prevention device according to the ninth embodiment will be described with reference to FIGS. 29 to 37.

Elements constituting the theft prevention device which are the same as those in the first to eighth embodiments have the same numerals.

The device includes an optical sensor for detecting a brightness and darkness of a light level, a vibration sensor composed of a mold body and a Hall-effect element and a ball respectively housed therein for detecting the vibration of the good, and an alarm circuit for receiving the signal provided by the optical sensor and the signal provided by the vibration sensor for providing an alarm after the lapse of a predetermined time when the signal detected by the optical sensor indicates that the brightness is changed to darkness and the signal detected by the vibration sensor indicates the vibration, the vibration sensor including a movable body in response to the vibration and a detecting body for detecting the operation of the movable body.

Figure 29:
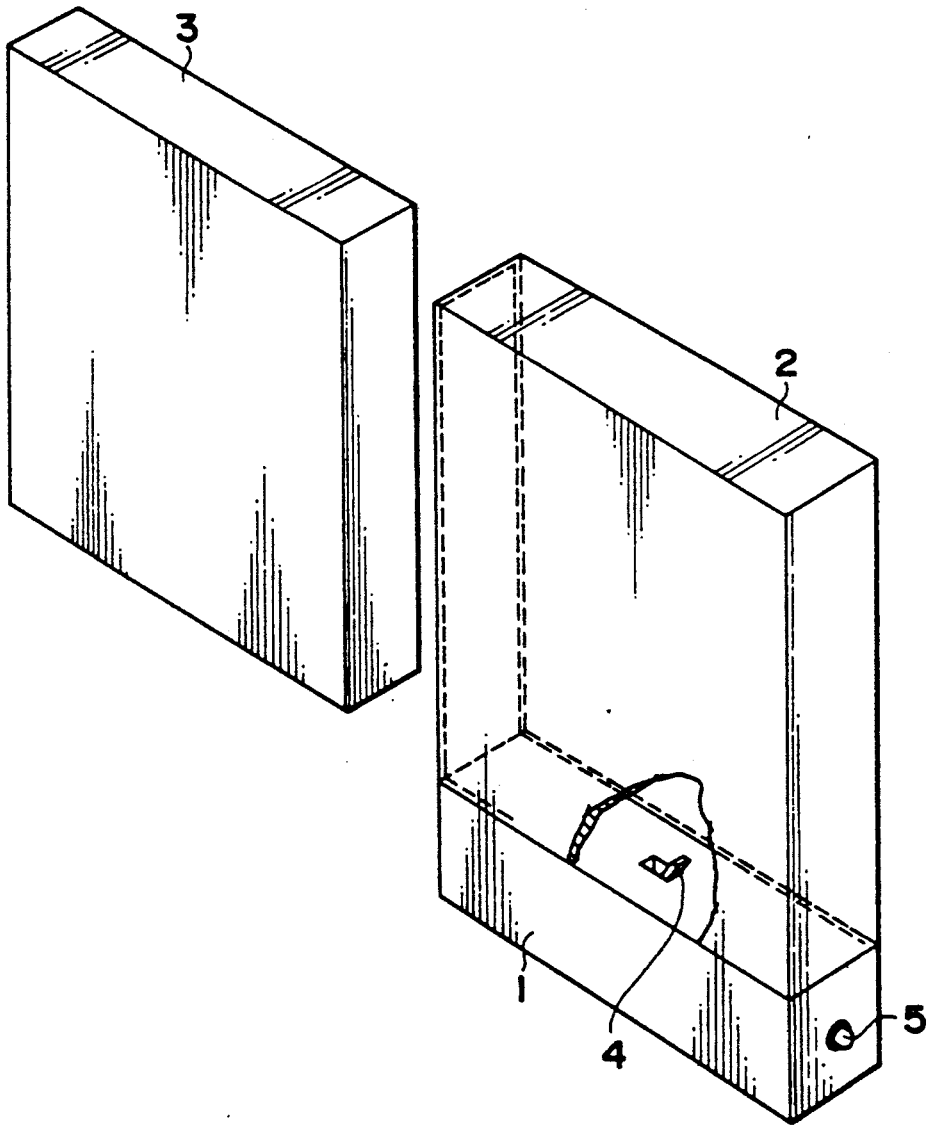
FIG. 29 is a perspective view of a theft prevention device according to a ninth embodiment of the present invention.
Figure 30:
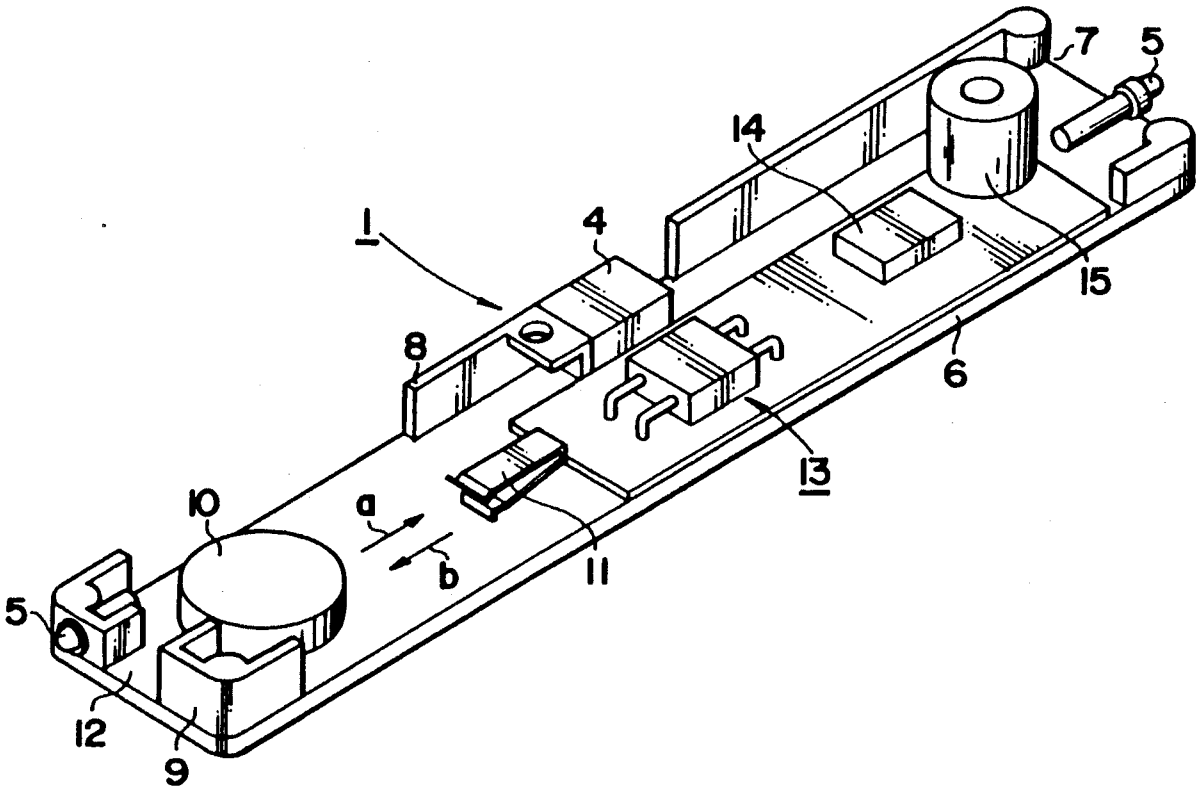
FIG. 30 is a block diagram showing an entire arrangement of FIG. 29.
Figure 31:
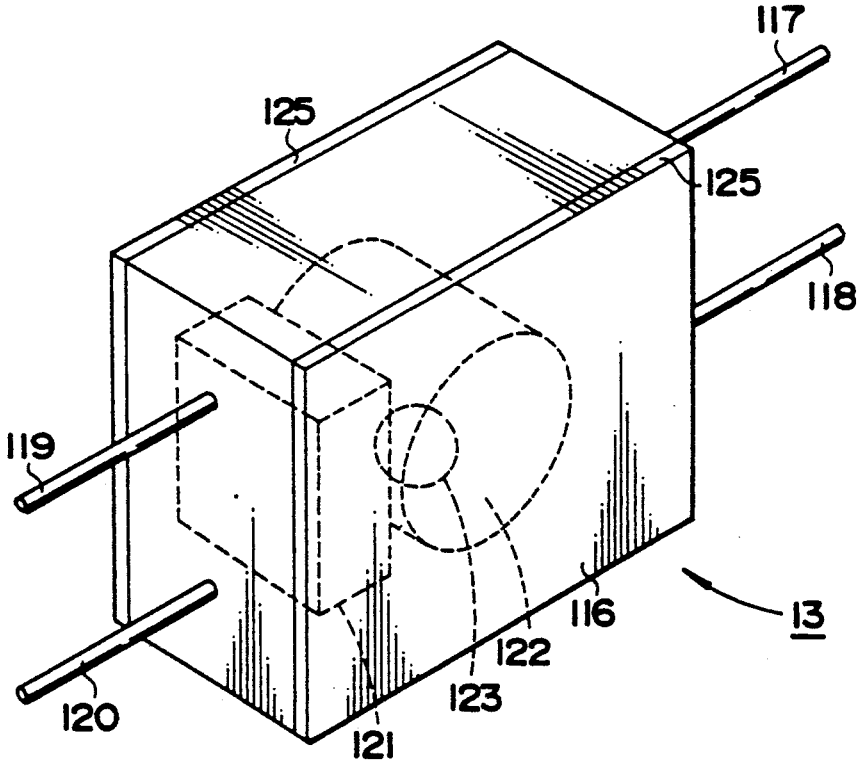
FIG. 31 is an enlarged perspective view of a vibration sensor employed in the device of FIG. 29.
Figure 32:
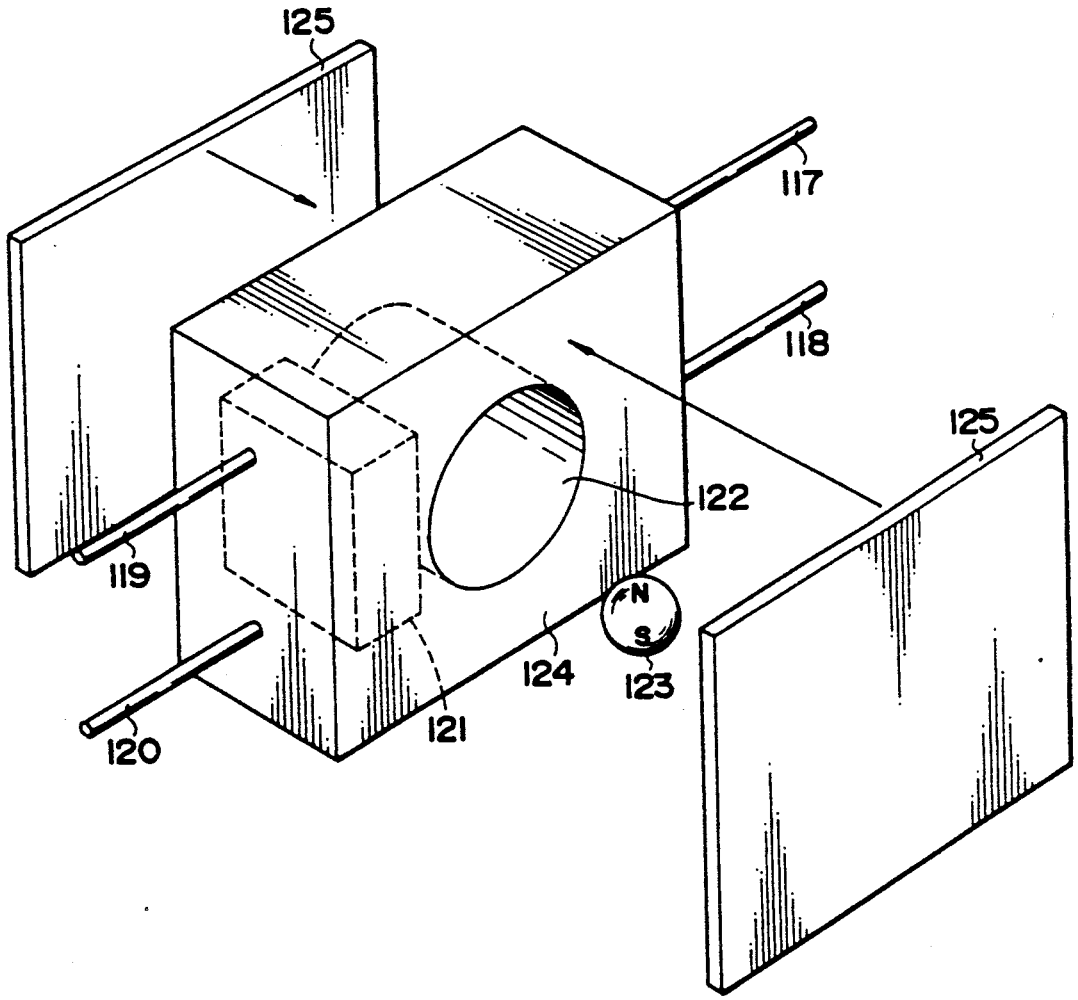
FIG. 32 is an exploded perspective view of FIG. 31.
Figure 33:
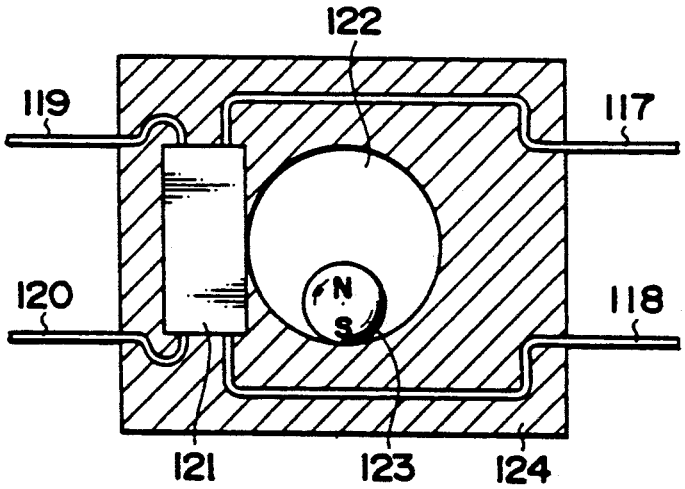
FIG. 33 is a cross sectional view of FIG. 31.
Figure 34:
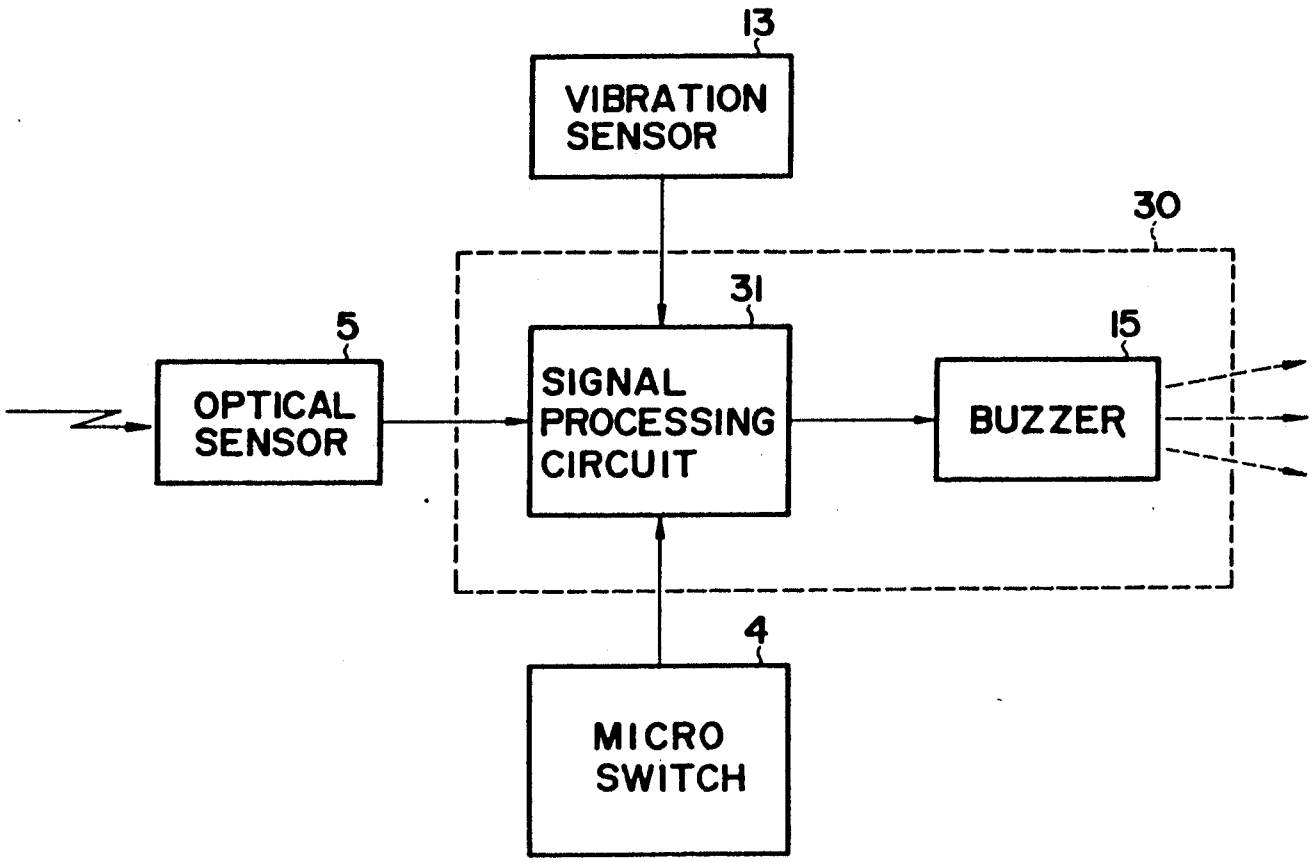
FIG. 34 is a block diagram showing the arrangement of FIG. 29.

As is evident from this structure, the arrangement of the theft prevention device has the same structure as the third embodiment except for the vibration sensor 13 and the vibration signal processing circuit 32 as shown in FIGS. 29 to 30. Hence the vibration sensor 13 and the vibration signal processing circuit 32 will be explained in more detail with reference to FIGS. 31 to 37.

The vibration sensor 13 is made of plastics and molded in a box shape 116. Protruded from the mold 116 are leads 117, 118 for the drive current and leads 119, 120 for detecting the signal. The Hall-effect element 121 is embedded inside the mold 116 and the leads 117, 118, 119, 120 are connected to the Hall-effect element 121. A cylindrical hollow portion 122 is provided inside the mold 116 and opened to both sides of the mold body 124. A ball 123 made of a magnetic member is disposed inside the cylindrical hollow portion 122. Plate members 125, 125 having the same size of the mold body 124 are adhered to the both sides of the mold body 124 by adhesive agents to complete the mold 116. Hence, the ball 123 can be freely movable inside the cylindrical hollow portion 122. As a result, the movement of the ball 123 can be detected by the Hall-effect element 121 and the resultant detected signal can be output from the leads 119, 120 as an electric signal.

Figure 35:
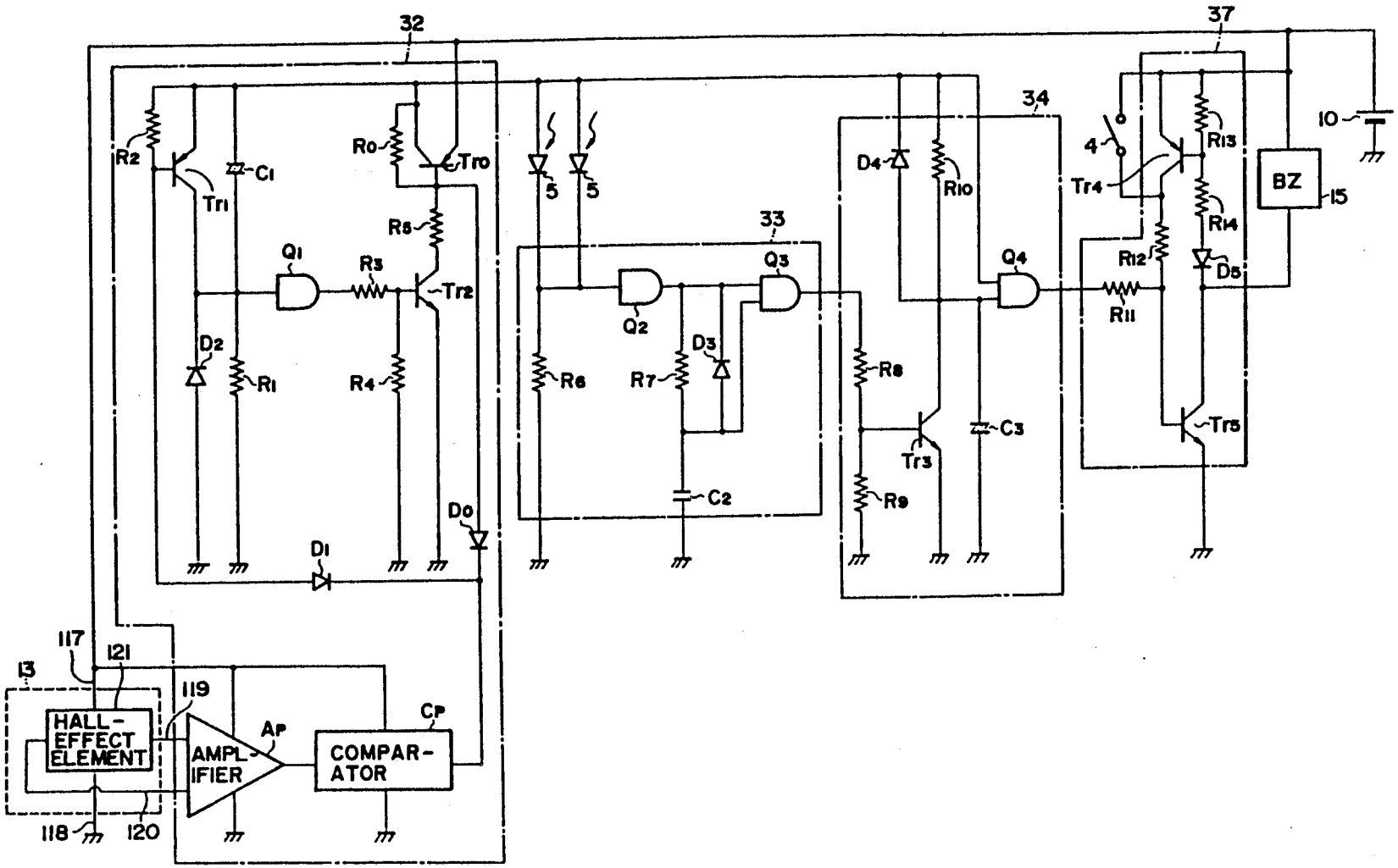
FIG. 35 is a circuit diagram showing the arrangement of FIG. 29.

As seen in FIG. 35, the vibration signal circuit 32 includes a detecting processing circuit composed of an operational amplifier Ap, a comparator Cp, a power supply switching circuit composed of a transistor Tr5, a resistor R0 and a diode D0, and a holding circuit composed of transistors Tr1, Tr2, diodes D1, D2, a capacitor C1, resistors R1 to R5 and an amplifier circuit Q1. The signal provided by the vibration sensor 13 is processed by the detecting processing circuit to thereby provide a signal. The holding circuit is driven upon reception of the signal provided by the detecting processing circuit for turning on the power supply switching circuit for a prescribed time.

An operation of the theft prevention device having such a structure according to the ninth embodiment will be described with reference to FIGS. 29 to 37.

In the case where the device 1 is in a motionless state, the vibration sensor 13 is turned off since the ball 123 is motionless and the output from the Hall-effect element 21 is not changed and the comparator Cp is turned off. Hence the transistor Tr0 of the vibration signal processing circuit 32 is also turned off (before t1 in FIG. 37). Hence, the power is not supplied from the cell 10 to the vibration signal processing circuit 32, the noise-removing circuit 33 and the timer circuit 34 so that the circuits do not operate (before t1 in FIG. 37).

When the good 3 is removed from the transparent case 2 of the device 1 the micro switch 4 is turned o and the transistor Tr5 is maintained on by the holding circuit composed of the resistors R12–R14, the transistor Tr4 and the diode D4. Accordingly, the buzzer 15 continues to sound even if the good 3 is returned to the transparent case 2 (FIG. 36(*g*), (*f*)).

The good 3 may be stolen in a manner where it is accommodated in the transparent case 2. Assume that the good 3 is placed in a pocket. The action of placing the good 3 in the pocket is accompanied by vibration. The vibration, namely, the movement of the ball 123 in the cylindrical hollow portion 122 of the mold 116, is converted to an electric signal signal by the Hall-effect element 121. Hence, the vibration sensor 13 provides the electric signal indicative of the movement of the ball 123 (FIG. 36(*g*), t1 to t2 in FIG. 37). The electric signal provided by the Hall-effect element 121 is amplified by the operational amplifier Ap of the vibration signal processing circuit 32 and supplied to the comparator Cp. The comparator Cp detects the amplified signal having an amplitude of more than a prescribed magnitude and supplies an ON signal to the diodes D0, D1.

When the ON signal is supplied to the diodes D0, D1, the transistor Tr0 is first turned on so that the power is supplied from the mini cell 10 to the vibration signal processing circuit 32 and the associated circuits. Simultaneously, the vibration signal processing circuit 32 is turned on for a predetermined time (e.g. 15 seconds from the time t2 in FIG. 37) counting from the time when the transistor Tr1 is turned on and successively the vibration sensor is turned off so that the power is supplied from the cell 10 to the other circuits (t1 to t5 in FIG. 37). As a result, the transistor Tr2 is turned on and successively the transistor Tr0 is turned on so that the power is continually supplied to the vibration signal processing circuit 32 and the associate circuits (FIG. 36(*b*), t1 to t5 in FIG. 37). As long as the vibration continues, the power from the cell 10 is supplied to the other circuits from the vibration signal processing circuit 32.

Figure 36:
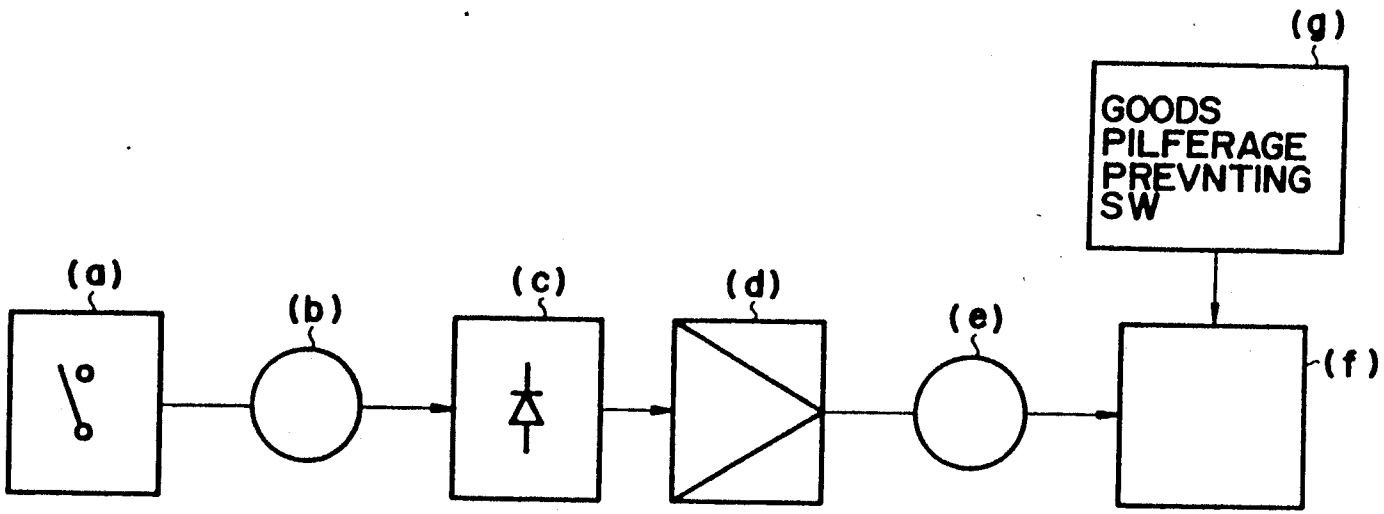
FIG. 36 is a view of assistance in explaining an operation of the arrangement of FIG. 29.
Figure 37:
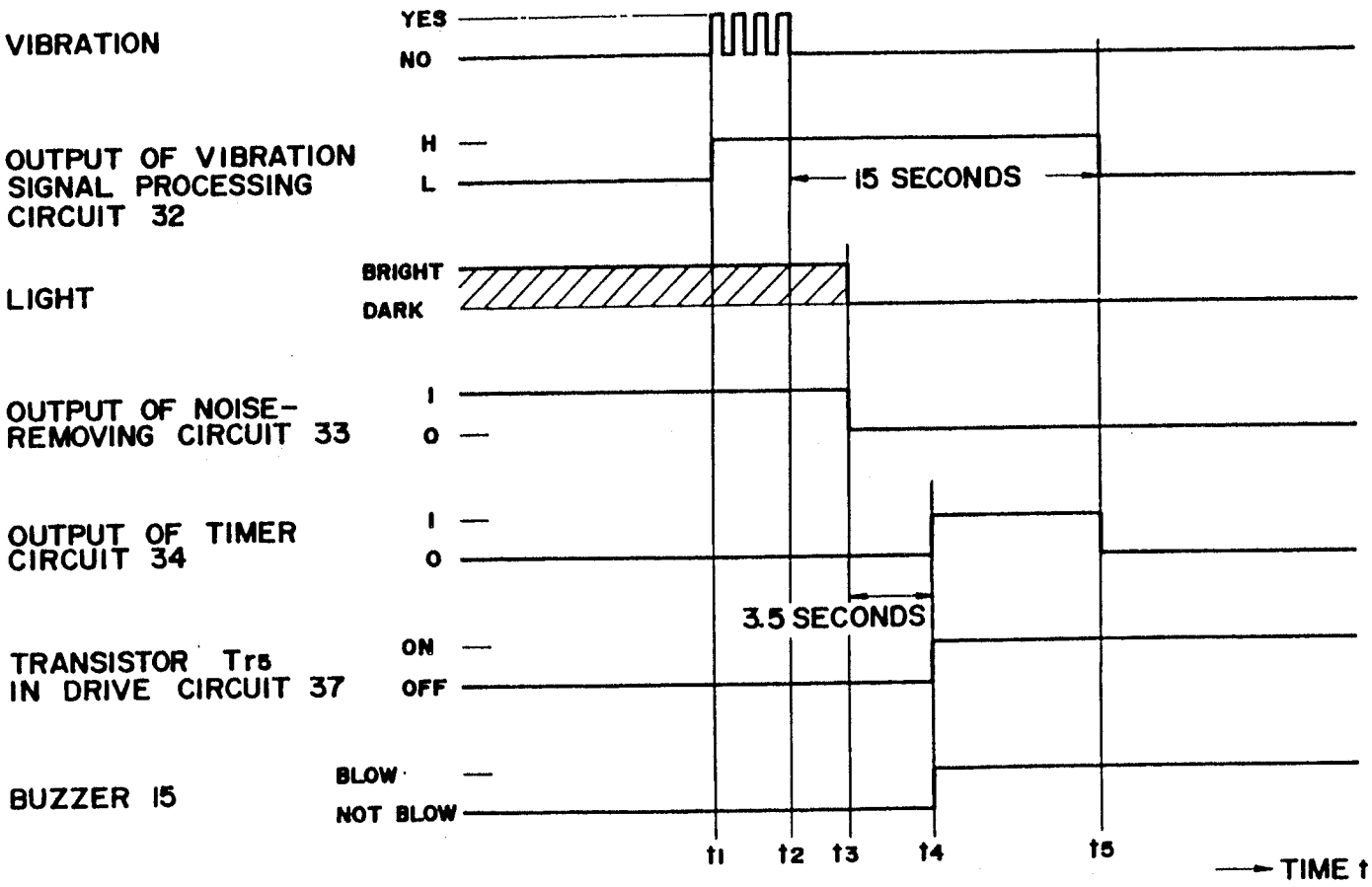
FIG. 37 is at timing chart showing an operation of the arrangement of FIG. 29.

At this state, when light is detected by the optical sensor 5 (FIG. 36(*c*), t3 in FIG. 37), the noise in the detected signal is removed by the noise-removing circuit 33 (FIG. 36(*d*)) and the detected signal having no noise is supplied to the timer circuit 34. However, the timer circuit 34 does not operate since the light is not detected. However, when the light is blocked due to the theft when the power is kept supplied, the blockage of the light is detected by the optical sensor 5 (FIG. 36(*c*), t3 in FIG. 37). The blockage of the light, namely the darkness, continues for a prescribed time (t3 to t4 in FIG. 37), the timer circuit 34 is operated to provide a signal "1" to the drive circuit 37 (FIG. 34(*e*), t4 in FIG. 35). As a result, the transistor Tr5 in the drive circuit 37 is turned on and successively the transistor Tr4 is turned on to thereby thereafter permit the buzzer 15 to continue sounding until the life of the cell 10 is expired irrespective of the state set forth above (FIG. 36(*b*), after t4 in FIG. 37).

Tenth Embodiment (FIGS.. 38 to 40)

Figure 38:
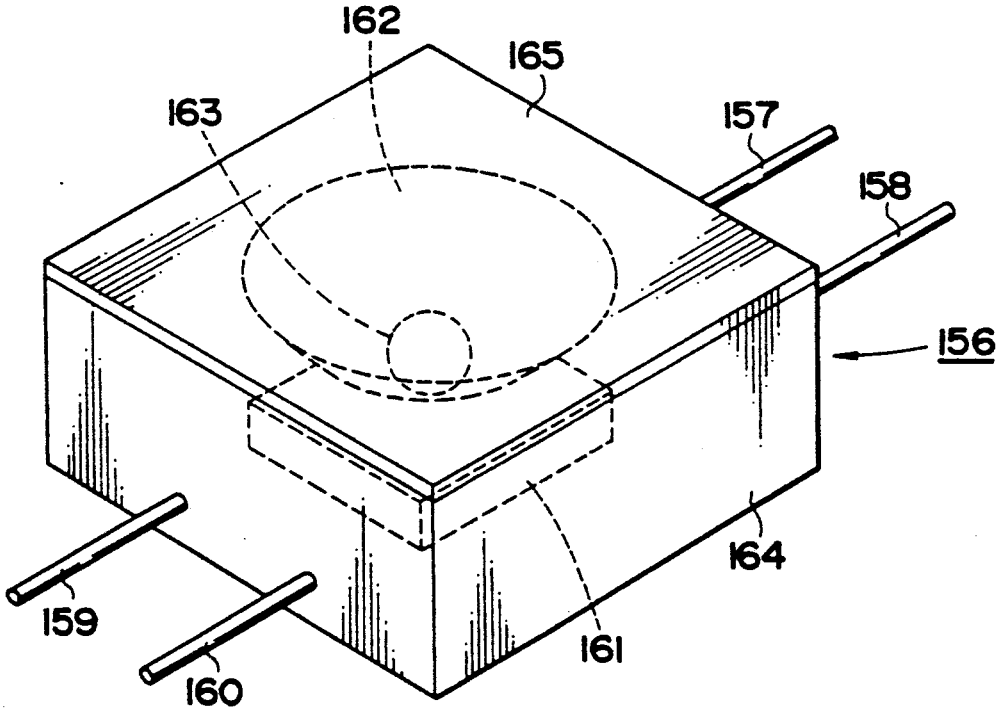
FIG. 38 is an enlarged perspective view showing a modified vibration sensor employed in a theft prevention device according to a tenth embodiment of the present invention.
Figure 39:
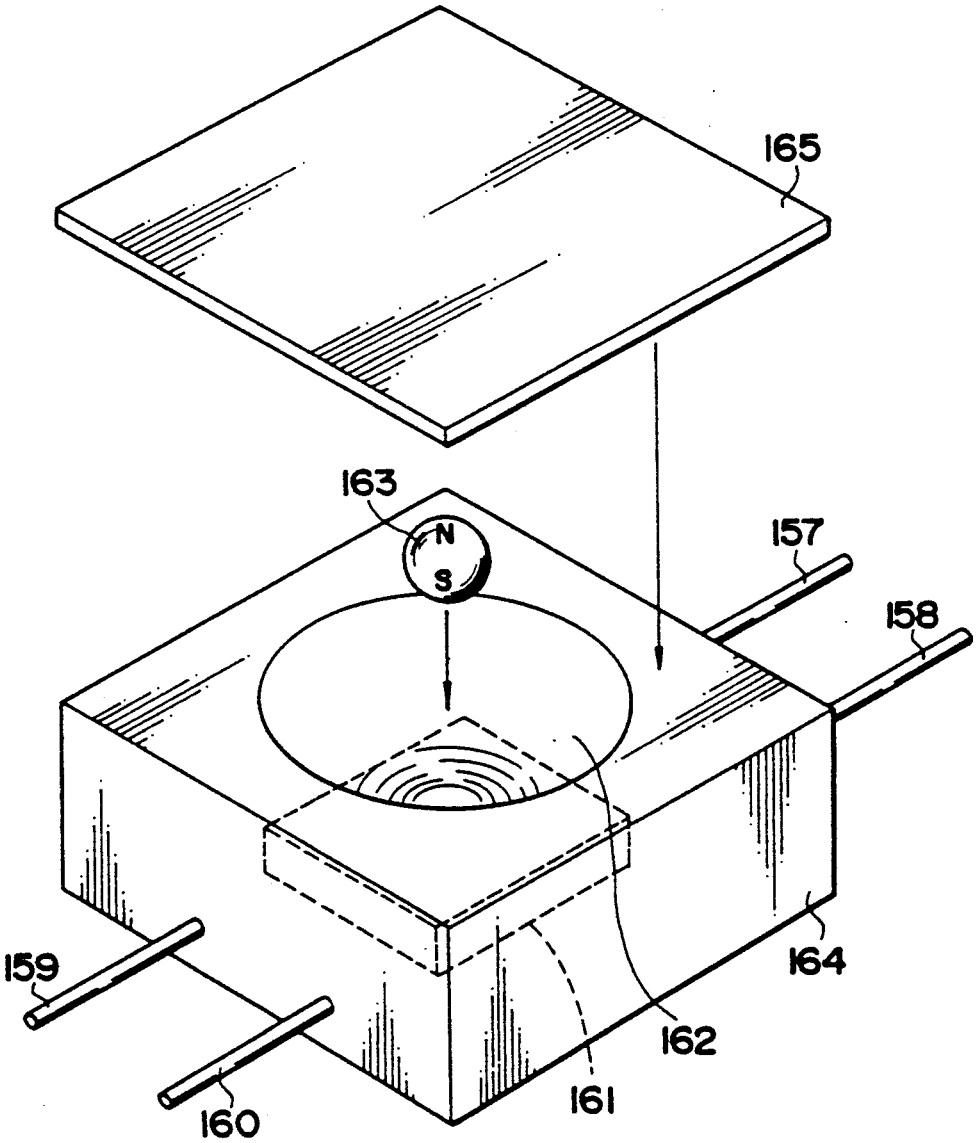
FIG. 39 is an exploded perspective view of FIG. 38.
Figure 40:
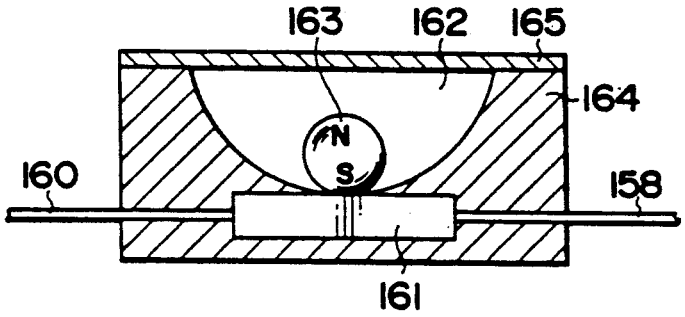
FIG. 40 is a cross sectional view of FIG. 38.

A theft prevention device having a modified vibration sensor according to the tenth embodiment will be described with reference to FIGS. 38 to 40.

The vibration sensor 13 includes a box-shaped mold 156 made of plastics, etc. and current driving leads 157, 158, and signal detecting leads 159, 160 protruded from the mold 156. A Hall-effect element 161 is embedded in the central lower portion of a mold body 164. A hemispherical recessed portion 162 is provided over the detecting surface of the Hall-effect element 161 and a ball 163 made of a magnetic member is placed on the Hall-effect element 161. A plate 165 having the same size as the mold body 164 is adhered to one side of the mold body 164 by the adhesive agent in the manner to close the recessed portion 162.

The vibration sensor 13 is designed so that the ball 163 is disposed on the bottom of the recessed portion 162 (the detecting surface of the Hall-effect element 161) and rotatably moved when the theft prevention device is moved. The rotatable movement of the ball 163 is electrically detected by the Hall-effect element 161 and the detected signal is output from the signal detecting leads 159, 160, whereby the vibration can be detected.

Figure 41:
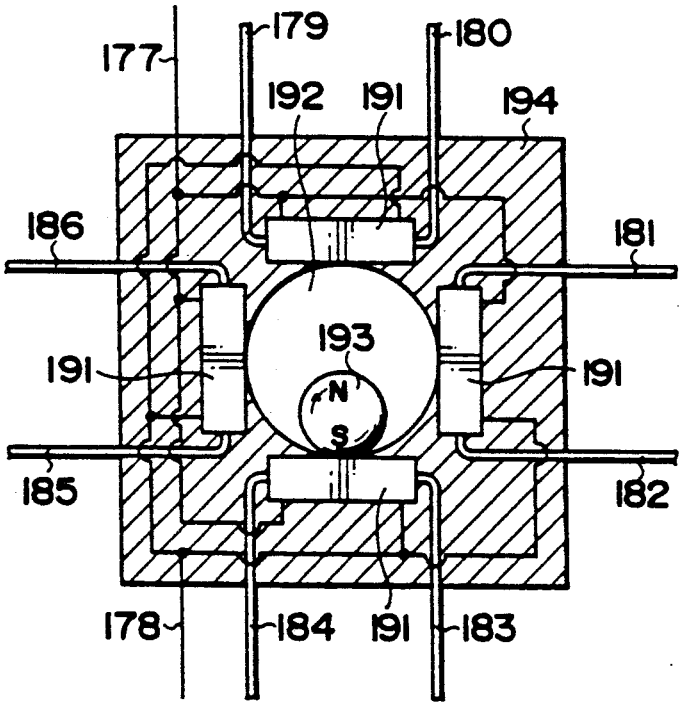
FIG. 41 is a view showing a further modified vibration sensor employed in a theft prevention device according to an eleventh embodiment of the present invention.

Eleventh Embodiment (FIG. 41)

A theft prevention device further having a modified vibration sensor according to the eleventh embodiment will be described with reference to FIG. 41.

The vibration sensor 13 includes a box-shaped mold 176 made of plastics, etc., current driving leads 177, 178 and signal detecting leads 179, 10, 181, 182, 183, 184, 185, 186 protruded from the mold 176. Four Hall-effect elements 191 are disposed in a mold body 194 and periphery of the circular hollow portion 192. A ball 193 made of a magnetic member is placed on the circular hollow portion 192. According to the vibration sensor having such a structure, the vibration can be detected without specifying the detecting surface. The circuit diagram of the vibration sensor is the same as that of the ninth embodiment as illustrated in FIG. 35. The signal detecting leads 179 to 186 are connected in parallel and across in a manner that the leads 179, 180; the leads 183, 184 are connected in parallel to each other, the leads 181, 182; the leads 185, 186 are connected in parallel to each other and crosses with the leads 179, 180; and the leads 183, 184.

The following advantages will obtained according to the ninth embodiment to eleventh embodiment.

The Hall-effect element can detect the movement of the ball made of the magnetic member for thereby detecting the vibration with a high accuracy and simple structure.

Inasmuch as the movement of the ball can be restricted within the circular hollow portion, the device can be simplified in structure and can be reduced in size.

Although the invention has been described in its preferred form with a certain degree of particularity, it is to be understood that many variations and changes are possible in the invention without departing from the scope thereof.

What is claimed is:

1. A theft prevention device comprising an optical sensor for detecting a level of ambient light, a vibration sensor for detecting vibration of a protected article, and an alarm circuit operatively coupled to the optical sensor and the vibration sensor for providing an alarm when the optical sensor detects a change in the level of ambient light from relative brightness to relative darkness and the vibration sensor detects a vibration of the protected article.

2. A theft prevention device according to claim 1, wherein the alarm circuit includes means for emitting an electromagnetic wave to activate the alarm.

3. A theft prevention device according to claim 1, wherein said alarm circuit comprises a signal processing circuit and a buzzer.

4. A theft prevention device according to claim 3, wherein said signal processing circuit comprises a first signal processing circuit responsive to an optical vibratory system which includes the optical and vibration sensors and a second signal processing circuit responsive to the disconnection sensor.

5. A theft prevention device according to claim 4, wherein the first signal processing circuit comprises an optical signal circuit responsive to the optical sensor, a drive circuit for activating the buzzer and a vibration signal circuit responsive to the vibration sensor.

6. A theft prevention device comprising an optical sensor for detecting a level of ambient light, a vibration sensor for detecting vibration of a protected article, a disconnection sensor for detecting a disconnection of a member attached to the protected article, and an alarm circuit operatively coupled to the optical sensor, the vibration sensor and the disconnection sensor for providing an alarm when the optical sensor detects a change in the level of the ambient light from relative brightness to relative darkness and the vibration sensor detects a vibration of the protected article, or when the disconnection sensor detects a disconnection of the member.

7. A theft prevention device according to claim 6, wherein the alarm is audible.

8. A theft prevention device according to claim 6, wherein the alarm circuit comprises a signal processing circuit, an alarm wave generating circuit and an antenna.

9. A theft prevention device comprising an optical sensor for detecting a level of ambient light, a vibration sensor for detecting vibration of a protected article, and an alarm circuit operatively coupled to the optical sensor and the vibration sensor for providing an alarm when the optical sensor detects a change in the level of the ambient light from relative brightness to relative darkness and the vibration sensor detects a vibration of the protected article, the vibration sensor being composed of a body movable in response to vibration of the vibration sensor and a detecting body for detecting a movement of the movable body.

10. A theft prevention device according to claim 9, wherein the movable body is composed of a shaft fixedly mounted to a base, an elongated member pivotally mounted on the shaft at one end thereof, a conductive member mounted at the other end of the elongated member and a coil spring for urging the elongated member to return to a predetermined position, and wherein the detecting body is composed of a conductive stopper having projecting portions positioned along a radius of movement of the conductive member mounted to the elongated member.

11. A theft prevention device according to claim 9, wherein the movable body is composed of a shaft fixedly mounted to a base, an elongated member pivotally mounted on the shaft at one end thereof, a magnetic body mounted at the other end of the elongated member and a coil spring for urging the elongated member to return to a predetermined position, and a detecting body having a detecting coil which is positioned along a radius of movement of the magnetic body mounted to the elongated member.

12. A theft prevention device according to claim 9, wherein the movable body is composed of a base, a shaft fixedly mounted to the base, a disk rotatably mounted on the shaft, magnetic bodies provided at a periphery of the disk and a weight provided at the periphery of the disc for gravitationally biasing the disk to thereby return the magnetic bodies to a predetermined position after disturbance, and a detecting body comprising a detecting coil provided on the base.

13. A theft prevention device according to claim 9, wherein the alarm circuit comprises a signal processing circuit composed of a vibration signal processing circuit for processing a signal provided by the vibration sensor, a noise-removing circuit for filtering a specific frequency from a signal provided by the optical sensor and for outputting a corresponding filtered optical sensor signal, a timer circuit for providing an output signal when the filter optical sensor signal from the noise-removing circuit is continuously present for a predetermined time, and a drive circuit for driving the alarm upon reception of the output signal provided by the timer circuit.

14. A theft prevention device according to claim 13, wherein the vibration signal processing circuit comprises a power supply switching circuit composed of a first transistor connected to a power supply at an emitter thereof, a first resistor connected to the first transistor at a collector thereof, a first diode connected to the first transistor at a base thereof, and second and third transistors, a second diode connected to a base of the second transistor, a third diode connected to a collector of the second transistor, a capacitor connected to a second resistor, a third resistor connected to a base of the second transistor, a fourth resistor connected to an output of an amplifier and to a base of the third transistor, a fifth resistor having one end connected to a junction point between the fourth resistor and the base of the third transistor and the other end grounded, and a sixth resistor connected to the base of the first transistor.

15. A theft prevention device according to claim 13, wherein the noise-removing circuit comprises the optical sensor, an amplifier circuit for receiving a detected signal from a junction point between the optical sensor and a first resistor, and a low-pass filter composed of a second resistor, a capacitor, a diode, and an AND circuit for filtering the noise from the detected signal provided by the amplifier circuit.

16. A theft prevention device according to claim 13, wherein the timer circuit comprises an input amplifying portion composed of input resistors and a transistor and a delay circuit composed of a resistor, a diode, a capacitor, and an AND circuit.

17. A theft prevention device according to claim 13, wherein the drive circuit comprises a buzzer switch circuit composed of an input resistor connected to an output terminal of said timer circuit and a driving transistor having an emitter which is grounded and a base connected to the input resistor and a collector connected to a diode, and a holding circuit composed of resistors, a transistor and the diode for keeping the buzzer switch turned on.

18. A theft prevention device comprising an optical sensor for detecting a level of ambient light and for converting the detected light level to a first electric signal, a vibration sensor for detecting a vibration of a protected article and for converting the detected vibration to a second electric signal, and an alarm circuit for receiving the first electric signal provided by the optical sensor and the second electric signal provided by the vibration sensor and for providing an alarm when the first electric signal provided by the optical sensor exceeds a predetermined frequency at a time when a vibration of the protected article is detected by the vibration sensor.

19. A theft prevention device according to claim 18, wherein the alarm circuit provides an alarm after the lapse of a predetermined time in which the first electric signal provided by the optical sensor indicates a change in the level of the ambient light from relative brightness to relative darkness or in which the first electric signal provided by the optical sensor exceeds a predetermined frequency.

20. A theft prevention device according to claim 18, further including a lighting device provided at an exit of a place in which the protected article is located for emitting light at a frequency exceeding the predetermined frequency.

21. A theft prevention device comprising an optoelectronic element for generating an optoelectronic voltage responsive to the incidence of light, an optical processing circuit for receiving the optoelectronic voltage generated by the optoelectronic element for charging a cell for supplying power to constituents of the device, a vibration sensor for detecting vibration of a protected article, and an alarm circuit operatively coupled to the vibration sensor and the optoelectronic element for providing an alarm when the optoelectronic element detects a change in a level of the light from relative brightness to relative darkness and the vibration sensor detects vibration of the protected article.

22. A theft prevention device according to claim 21, wherein the optical processing circuit is composed of a floating charging portion for supplying the optoelectronic voltage of the optoelectronic element to the cell through an isolation diode and a detecting circuit composed of a transistor and voltage divider resistors, said detecting circuit providing an output signal to the timer circuit when a dividing voltage of the voltage divider resistors is absent to thereby turn on the transistor at a time when the optoelectronic voltage is not applied thereto from the optoelectronic element.

23. A theft prevention device comprising an optoelectronic element for generating an optoelectronic voltage responsive to the incidence of light, an optical processing circuit for receiving the optoelectronic voltage generated by the optoelectronic element and for providing a first detecting signal, a vibration sensor for detecting vibration of a protected article and for providing a second detection signal indicative of the vibration, and an alarm circuit for receiving the second detections signal provided by the vibration sensor and the first detection signal provided by the optical processing circuit for providing an alarm when the first detection signal provided by the optical processing circuit indicates a change in a level of the light from relative brightness to relative darkness at a time when the vibration sensor detects vibration of the protected article.

24. A theft prevention device comprising an optical sensor for detecting a level of ambient light, a vibration sensor composed of a molded body and a Hall-effect element and a ball respectively housed therein for detecting vibration of a protected article, and an alarm circuit operatively coupled to the optical sensor and the vibration sensor for providing an alarm when the optical sensor detects a change in the level of the ambient light from relative brightness to relative darkness and the vibration sensor detects vibration of the protected article, wherein the ball is made of a magnetic material and is movably disposed adjacent a detecting surface of the Hall-effect element.

25. A theft prevention device according to claim 24, wherein the molded body has therein a cylindrical hollow portion in which the ball made of the magnetic material is disposed, the Hall-effect element having a detecting surface which is adjacent an inner periphery of the cylindrical hollow portion.

26. A theft prevention device according to claim 24, wherein the molded body has therein a hemispherical hollow portion in which the ball made of the magnetic material is disposed, the Hall-effect element having a detecting surface which is adjacent an inner periphery of the hemispherical hollow portion.

* * * * *